US012472407B2

(12) United States Patent
Milleman et al.

(10) Patent No.: US 12,472,407 B2
(45) Date of Patent: Nov. 18, 2025

(54) GOLF CLUB HEADS WITH SLITS AND FLEXURE INSERTS

(71) Applicant: KARSTEN MANUFACTURING CORPORATION, Phoenix, AZ (US)

(72) Inventors: Travis D. Milleman, Cave Creek, AZ (US); Eric J. Morales, Laveen, AZ (US); Joshua A. Degerness, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 18/153,829

(22) Filed: Jan. 12, 2023

(65) Prior Publication Data

US 2023/0233908 A1 Jul. 27, 2023

Related U.S. Application Data

(60) Provisional application No. 63/371,613, filed on Aug. 16, 2022, provisional application No. 63/266,722, filed on Jan. 12, 2022.

(51) Int. Cl.
*A63B 53/04* (2015.01)

(52) U.S. Cl.
CPC ..... *A63B 53/0433* (2020.08); *A63B 53/0408* (2020.08); *A63B 53/0437* (2020.08); *A63B 53/0466* (2013.01); *A63B 2209/00* (2013.01)

(58) Field of Classification Search
CPC ..... A63B 53/0433; A63B 53/0408; A63B 53/0437; A63B 53/0466; A63B 2209/00; A63B 60/52
See application file for complete search history.

(56) References Cited

U.S. PATENT DOCUMENTS

| | | | |
|---|---|---|---|
| 5,492,327 | A | 2/1996 | Biafore, Jr. |
| 6,379,265 | B1 | 4/2002 | Hirakawa |
| 6,602,149 | B1 | 8/2003 | Jacobson |
| 6,669,576 | B1 | 12/2003 | Rice |

(Continued)

FOREIGN PATENT DOCUMENTS

| | | |
|---|---|---|
| GB | 2445056 | 6/2008 |
| JP | 2003210621 | 7/2003 |

(Continued)

OTHER PUBLICATIONS

Philosophical Magazine, vol. 94, 2014—Issue 1, On the Relationship Between Hardnes and the Elastic and Plastic Properties of Isotropic Power-Law Hardening Materials, Hongzhi Lan & T. A. Venkatesh, https://www.tandfonline.com/doi/abs/10.1080/14786435.2013.839889, 2014.*

(Continued)

*Primary Examiner* — William M Pierce

(57) ABSTRACT

Described herein are embodiments of golf club heads with slits and flexure inserts. The slit comprises an opening through the club head body communicating between the exterior of the club head and the hollow interior cavity. The flexure insert can comprise a spring component and a cap. The spring component creates a spring effect within the flexure insert that increases the internal energy of the club head at impact, leading to improvements in ball speed and other golf ball performance characteristics.

4 Claims, 20 Drawing Sheets

(56) References Cited

U.S. PATENT DOCUMENTS

| | | | | |
|---|---|---|---|---|
| 6,860,823 | B2 | 3/2005 | Lee | |
| 7,025,692 | B2 | 4/2006 | Erickson | |
| 7,082,665 | B2 | 8/2006 | Deshmukh | |
| 7,153,221 | B2 | 12/2006 | Hocknell | |
| 7,285,060 | B2 | 10/2007 | Williams | |
| 7,749,101 | B2 | 7/2010 | Imamoto | |
| 7,993,216 | B2 | 8/2011 | Lee | |
| 8,177,659 | B1 | 5/2012 | Ehlers | |
| 8,663,028 | B2 | 3/2014 | Nakano | |
| 8,668,601 | B1 | 3/2014 | Peralta | |
| 9,089,747 | B2 | 7/2015 | Boyd | |
| 9,101,808 | B2 * | 8/2015 | Stites | A63B 60/00 |
| 9,108,090 | B2 | 8/2015 | Stites | |
| 9,211,449 | B2 | 12/2015 | Demille | |
| 9,370,698 | B2 | 6/2016 | Deshmukh | |
| 9,421,431 | B2 | 8/2016 | Nishio | |
| 9,427,631 | B1 | 8/2016 | Larson | |
| 9,492,721 | B2 | 11/2016 | Ghods | |
| 9,623,292 | B2 | 4/2017 | Abe | |
| 9,623,293 | B2 | 4/2017 | Abe | |
| 9,675,850 | B2 | 6/2017 | Bennett | |
| 9,682,290 | B2 | 6/2017 | Shear | |
| 9,682,293 | B2 | 6/2017 | Bennett | |
| 9,694,255 | B2 | 7/2017 | Oldknow | |
| 9,700,765 | B2 | 7/2017 | Frame | |
| 9,750,991 | B2 | 9/2017 | Chao | |
| 9,770,632 | B2 | 9/2017 | Boyd | |
| 9,839,817 | B1 | 12/2017 | Johnson | |
| 9,839,820 | B2 | 12/2017 | Bennett | |
| 9,849,357 | B2 | 12/2017 | Wahl | |
| 9,878,222 | B2 | 1/2018 | Morales | |
| 9,901,791 | B2 | 2/2018 | Mizutani | |
| 10,004,953 | B2 | 6/2018 | Stites | |
| 10,039,961 | B2 | 8/2018 | Golden | |
| 10,080,934 | B2 | 9/2018 | Beach | |
| 10,130,850 | B2 | 11/2018 | Fossum | |
| 10,137,336 | B2 | 11/2018 | Mizutani | |
| 10,195,500 | B2 | 2/2019 | Oldknow | |
| 10,245,480 | B2 | 4/2019 | Oldknow | |
| 10,279,224 | B1 | 5/2019 | Webb | |
| 10,343,032 | B2 * | 7/2019 | Martens | A63B 60/02 |
| 10,343,033 | B2 * | 7/2019 | Frame | A63B 60/54 |
| 10,449,425 | B2 | 10/2019 | Mizutani | |
| 10,543,404 | B2 | 1/2020 | Kohno | |
| 10,543,409 | B2 | 1/2020 | Demkowski | |
| 10,646,756 | B2 | 5/2020 | Beach | |
| 10,806,978 | B2 * | 10/2020 | Golden | A63B 53/06 |
| 10,894,193 | B2 | 1/2021 | Chen | |
| 11,141,632 | B2 | 10/2021 | Taylor | |
| 11,148,018 | B2 | 10/2021 | Grenier | |
| 11,684,830 | B2 | 6/2023 | Mizutani | |
| 11,794,082 | B1 * | 10/2023 | Tsuji | A63B 53/0433 |
| 11,931,628 | B2 * | 3/2024 | Saito | A63B 53/0433 |
| 2002/0004428 | A1 | 1/2002 | Takeda | |
| 2004/0192463 | A1 | 9/2004 | Tsurumaki | |
| 2004/0266545 | A1 | 12/2004 | Gilbert | |
| 2005/0197208 | A1 | 9/2005 | Imamoto | |
| 2006/0052177 | A1 | 3/2006 | Nakahara | |
| 2007/0049417 | A1 | 3/2007 | Shear | |
| 2011/0021286 | A1 | 1/2011 | Boyd | |
| 2013/0324283 | A1 | 12/2013 | Boyd | |
| 2015/0190685 | A1 | 7/2015 | Boyd | |
| 2016/0332040 | A1 | 11/2016 | Lafortune | |
| 2016/0354656 | A1 | 12/2016 | Kato | |
| 2018/0318672 | A1 | 11/2018 | Sargent | |
| 2019/0275381 | A1 | 9/2019 | Bennett | |
| 2019/0366168 | A1 | 12/2019 | Franklin | |
| 2020/0030673 | A1 | 1/2020 | Sasamoto | |
| 2020/0368590 | A1 | 11/2020 | Mizutani | |
| 2020/0384319 | A1 | 12/2020 | Boyd | |
| 2021/0060393 | A1 | 3/2021 | Hoffman | |
| 2021/0093935 | A1 | 4/2021 | Jertson | |
| 2021/0128998 | A1 | 5/2021 | Jertson | |
| 2021/0275883 | A1 | 9/2021 | Serrano | |
| 2021/0316195 | A1 | 10/2021 | Burnett | |

FOREIGN PATENT DOCUMENTS

| | | | |
|---|---|---|---|
| JP | 2007117728 | 5/2007 | |
| JP | 2010234108 | 10/2010 | |
| JP | 2016221170 | 12/2016 | |
| JP | 3220756 U * | 4/2019 | A63B 53/04 |
| WO | 1999033530 | 7/1999 | |

OTHER PUBLICATIONS

Ping Wrx Custom Putter Add-on: Soundslot (also Called "floating Face" or "benching") at https://www.mortongolfsales.com/ping-wrx-custom-putter-add-on-soundslot-also-called-floating-face-or-beaching/, accessed on Oct. 31, 2021.

Tony Covey, "Titleist Tsi Fairway Woods" (Oct. 15, 2020) at https://mygolfspy.com/titleist-tsi-fairway-woods-tsi2-and-tsi3/, accessed on Oct. 31, 2021.

* cited by examiner

GOLF CLUB HEADS WITH SLITS AND FLEXURE INSERTS

CROSS REFERENCE PRIORITIES

This claims the benefit of U.S. Provisional Application No. 63/371,613, filed Aug. 16, 2022; and U.S. Provisional Application No. 63/266,722, filed Jan. 12, 2022, the contents of which are fully incorporated herein by reference.

FIELD OF INVENTION

This invention generally relates to golf equipment, and more particularly, to golf club heads having slits and flexure inserts to increase the flexure of the strike face for club head loft, ball speed, and ball spin manipulation.

BACKGROUND

Many golf club heads, in particular wood-type golf club heads (i.e. drivers, fairway woods, and hybrids), comprise features designed to control the flexure of the strike face at impact. In general, increasing the flexure of the strike face improves the performance of the club head by increasing ball speed and lowering spin, both of which can lead to gains in ball distance. Many prior art club heads seek to increase strike face flexure by providing an elongated slit proximate the strike face (also referred to herein as a "slot") comprising an aperture through a portion of the club head body and into the interior cavity. The slit is typically then filled with a lightweight, flexible insert to plug the aperture and seal the interior cavity. The lightweight and flexible insert is typically made from a soft, viscoelastic material to not limit the flexure of the slit.

Many prior art club heads focus on providing a viscoelastic, uniform-material insert. Due to the purely viscoelastic construction of the inserts used within the prior art slits, said inserts absorb and dissipate energy under compression, which reduces the overall energy transfer between the club head and the golf ball. The lesser energy transfer between the club head and the golf ball reduces ball speed and negatively impacts the performance of the club head.

Further, uniform-material and/or uniform-shape construction of the prior art inserts provide uniform flexure across the slit. The prior art inserts are not designed to control the flexure along various portions of the slit. The prior art inserts do not locally reinforce high-stress areas of the slit nor do they allow for maximum flexure in low-stress areas of the slit. Therefore, there is a need in the art for a golf club head with a slit and insert combination configured to locally control strike face and slit flexure and maximize energy transfer between the club head and the golf ball.

Figure 1:
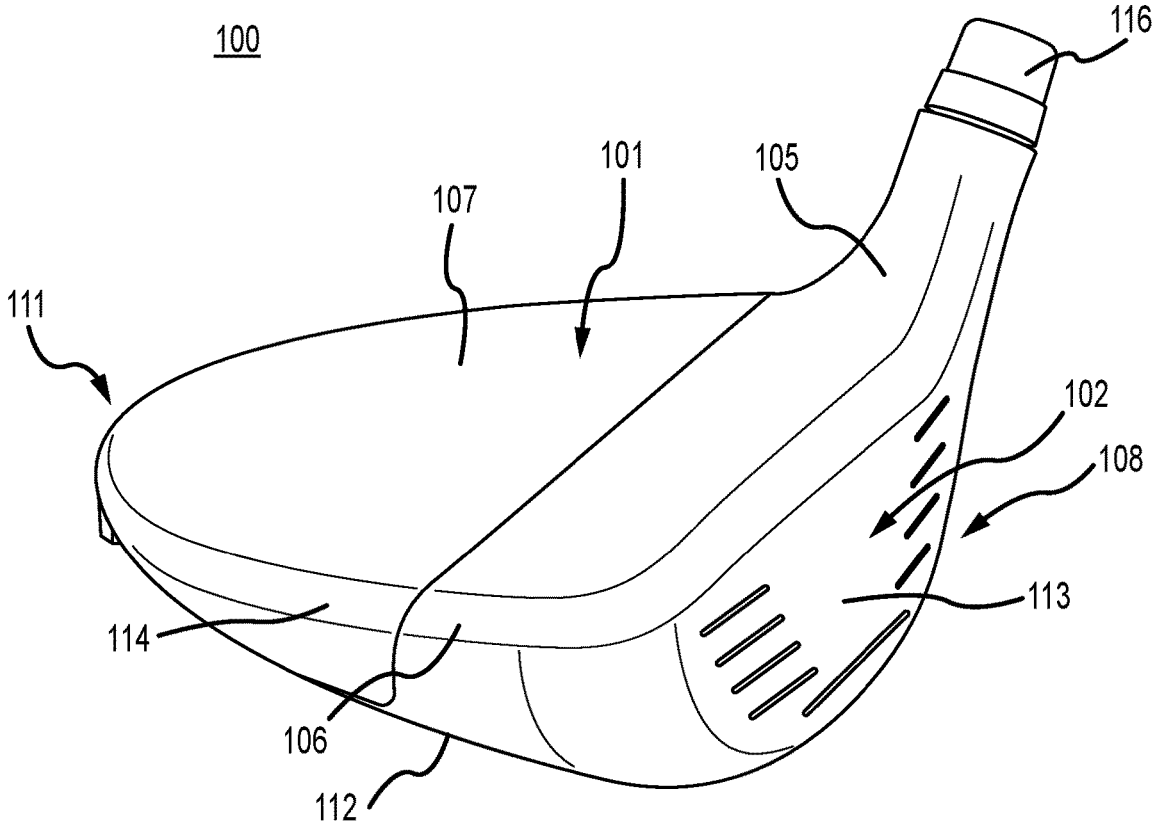
FIG. 1 illustrates a top perspective view of a wood-type club head comprising a slit and a flexure insert.

Described herein are various embodiments of wood type golf club heads (e.g. drivers, fairway woods, or hybrids) comprising slits and flexure inserts to strategically increase the flexure of the strike face. The club head comprises a flexure insert tailored to provide a desired amount of strike face flexure. The flexure insert provides benefits over a uniform prior art insert, which comprises uniform stiffness and bending properties across the entire slit. The flexure insert can be designed with variable stiffness and bending properties to locally reinforce high-stress areas of the slit and locally allow for maximum flexure in low-stress areas of the slit. In many embodiments, the flexure insert comprises a multi-material construction wherein the flexure insert comprises a cap and a spring component. The flexure insert always comprises two or more materials. The flexure insert provides benefits over a slit insert comprising a single material. The spring component can be provided in specific regions of the slit provide the desired stiffness profile of the flexure insert. Further, the spring component provides a spring effect that increases the energy transfer between the club head and the golf ball. The flexure insert allow for the stiffness and flexibility of the slit to be varied at different locations with the slit, allowing for more precise control over strike face flexure. The club head comprising a multi-material flexure insert provides performance benefits over the prior art inserts, which are typically made of a uniform shape and material and therefore do not provide variability to the stiffness or flexibility profile of the slit.

Further, the flexure insert embodiments described herein can lead to an increase in energy transfer between the club head and the golf ball. The spring component can be formed of a material with linearly elastic properties. The spring component efficiently stores internal energy as the flexure insert compresses at impact and releases said internal energy upon expansion. The linearly elastic nature of the spring component allows for more internal energy to be retained and released back to the strike face than a viscoelastic insert, such as the prior art. The purely viscoelastic inserts of the prior art dissipate a greater amount of energy. The club head comprising a flexure insert with a spring component provides increased ball speed and other performance benefits over a club head with an insert made of a purely viscoelastic material.

The club head described herein comprising a slit and multi-material flexure insert can result in significant improvements in strike face flexure and launch conditions over the single-material, viscoelastic prior art inserts. In particular, the slit and flexure insert comprising a spring component can lead to an increase in ball speed between 0.5 mph and 4.5 mph and an increase in internal energy between 3 lbf-in. and 20 lbf-in. Further, the slit and flexure insert comprising a spring component can provide other performance benefits, such as an increase in strike face deflection, increased dynamic lofting, and a reduction in ball spin rate.

The wood type golf club heads described in this disclosure can combine a slit and flexure insert with other club head features that improve performance. In some embodiments, the club head can utilize a multi-material design to increase MOI. In some embodiments, the club head can comprise a large mass pad located rearward the slit to provide a desirable CG location, increase ball speed and ball distance, and improve launch conditions. Any one or combination of the features described above can be combined with the slit and flexure insert to provide a high-performing club head.

DEFINITIONS

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The term "strike face," as used herein, refers to a club head front surface that is configured to strike a golf ball. The term strike face can be used interchangeably with the term "face."

The term "strike face perimeter," as used herein, can refer to an edge of the strike face. The strike face perimeter can be located along an outer edge of the strike face where the curvature deviates from a bulge and/or roll of the strike face.

The term "geometric centerpoint," or "geometric center" of the strike face, as used herein, can refer to a geometric centerpoint of the strike face perimeter, and at a midpoint of the face height of the strike face. In the same or other examples, the geometric centerpoint also can be centered with respect to an engineered impact zone, which can be defined by a region of grooves on the strike face. As another approach, the geometric centerpoint of the strike face can be located in accordance with the definition of a golf governing body such as the United States Golf Association (USGA).

The term "ground plane," as used herein, can refer to a reference plane associated with the surface on which a golf ball is placed. The ground plane can be a horizontal plane tangent to the sole at an address position.

The term "loft plane," as used herein, can refer to a reference plane that is tangent to the geometric centerpoint of the strike face.

The term "loft angle," as used herein, can refer to an angle measured between the loft plane and the XY plane (defined below in relation to the XYZ coordinate system).

The term "face height," as used herein, can refer to a distance measured parallel to loft plane between a top end of the strikeface perimeter and a bottom end of the strikeface perimeter.

The term "lie angle," as used herein, can refer to an angle between a hosel axis, extending through the hosel, and the ground plane. The lie angle is measured from a front view.

The "depth" of the golf club head, as described herein, can be defined as a front-to-rear dimension of the golf club head.

The "height" of the golf club head, as described herein, can be defined as a crown-to-sole dimension of the golf club head. In many embodiments, the height of the club head can be measured according to a golf governing body such as the United States Golf Association (USGA).

The "length" of the golf club head, as described herein, can be defined as a heel-to-toe dimension of the golf club head. In many embodiments, the length of the club head can be measured according to a golf governing body such as the United States Golf Association (USGA).

The "face height" of the golf club head, as described herein, can be defined as a height measured parallel to loft plane between a top end of the strike face perimeter near the crown and a bottom end of the strike face perimeter near the sole.

The "geometric center height" of the fairway-type golf club head, as described herein, is a height measured perpendicular from the ground plane to the geometric center-point of the golf club head.

The "leading edge" of the club head, as described herein, can be identified as the most sole-ward portion of the strike face perimeter.

Figure 2:
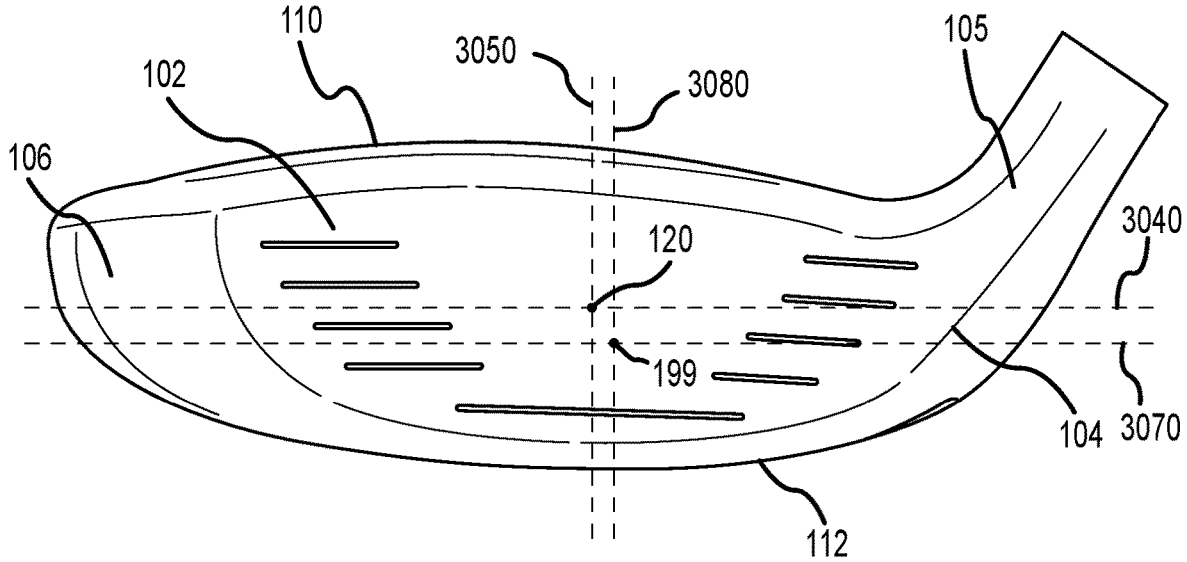
FIG. 2 illustrates a front view of the wood-type club head of FIG. 1.
Figure 3:
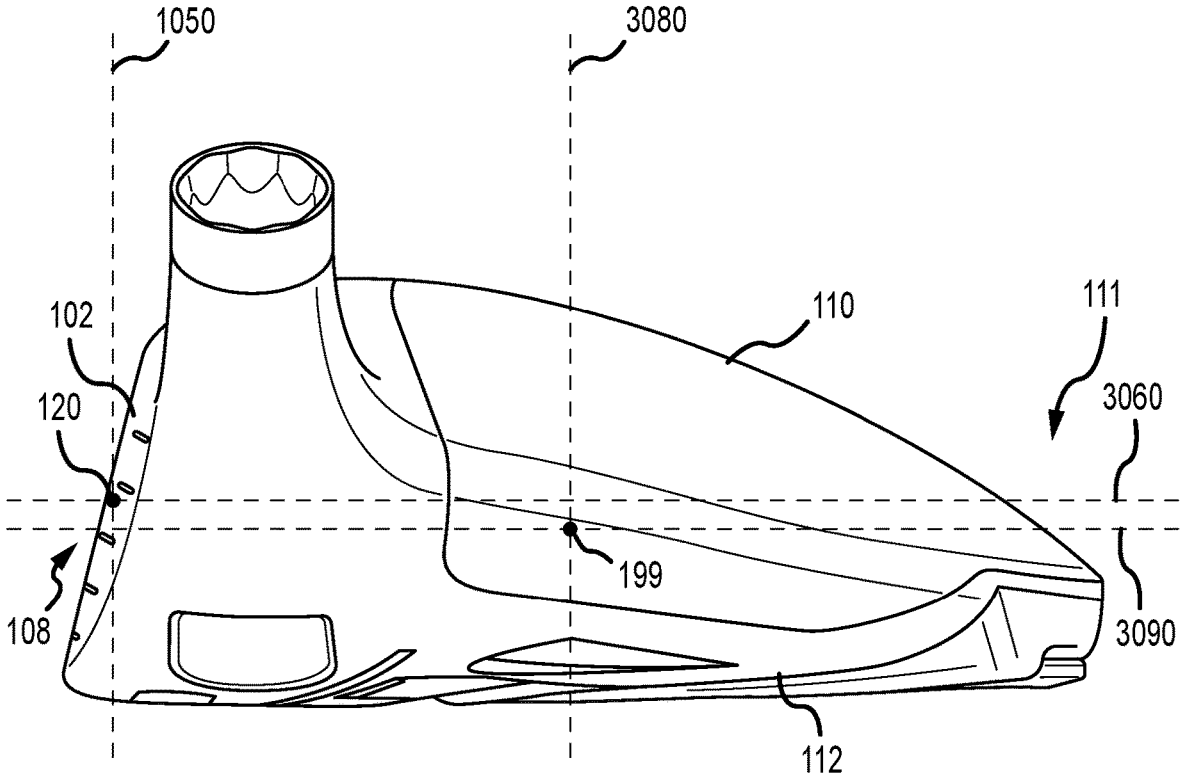
FIG. 3 illustrates a heel side view of the wood-type club head of FIG. 1.

Illustrated in FIGS. 2 and 3, an "XYZ" coordinate system of the golf club head 100, as described herein, is based upon the geometric center 120 of the strike face 102. The golf club head 100 dimensions as described herein can be measured based on a coordinate system as defined below. The geometric center 120 of the strike face 102 defines a coordinate system having an origin located at the geometric center 120 of the strike face 102. The coordinate system defines an X-axis 3040, a Y-axis 3050, and a Z-axis 3060. The X-axis 3040 extends through the geometric center 120 of the strike face 102 in a direction from the heel 104 to the toe 106 of the club head 100. The Y-axis 3050 extends through the geometric center 120 of the strike face 102 in a direction from the crown 110 to the sole 112 of golf club head 100. The Y-axis 3050 is perpendicular to the X-axis 3040. The Z-axis 3060 extends through the geometric center 120 of the strike face 102 in a direction from the front end 108 to the rear end 111 of the golf club head 100. The Z-axis 3060 is perpendicular to both the X-axis 3040 and the Y-axis 3050.

The term or phrase "center of gravity position" or "CG location" can refer to the location of the club head center of gravity (CG) 199 with respect to the XYZ coordinate system, wherein the CG position is characterized by locations along the X-axis 3040, the Y-axis 3050, and the Z-axis 3060. The term "CGx" can refer to the CG location along the X-axis 3050, measured from the origin point 120. The term "CG height" can refer to the CG location along the Y-axis 3050, measured from the origin point 120. The term "CGy" can be synonymous with the CG height. The term "CG depth" can refer to the CG location along the Z-axis 3060, measured from the origin point 120. The term "CGz" can be synonymous with the CG depth.

The XYZ coordinate system of the golf club head, as described herein defines an XY plane extending through the X-axis 3040 and the Y-axis 3050. The coordinate system defines XZ plane extending through the X-axis 1040 and the Z-axis 3060. The coordinate system further defines a YZ plane extending through the Y-axis 3050 and the Z-axis 3060. The XY plane, the XZ plane, and the YZ plane are all perpendicular to one another and intersect at the coordinate system origin located at the geometric center 120 of the strike face 102. In these or other embodiments, the golf club head 100 can be viewed from a front view when the strike face 102 is viewed from a direction perpendicular to the XY plane. Further, in these or other embodiments, the golf club head 100 can be viewed from a side view or side cross-sectional view when the heel 104 is viewed from a direction perpendicular to the YZ plane.

Illustrated in FIGS. 2 and 3, the golf club head 100 further comprises a coordinate system centered about the center of gravity 199. The coordinate system comprises an X'-axis 3070, a Y'-axis 3080, and a Z'-axis 3090. The X'-axis 3070 extends in a heel-to-toe direction. The X'-axis 3070 is positive towards the heel 104 and negative towards the toe 106. The Y'-axis 3080 extends in a sole-to-crown direction and is orthogonal to both the Z'-axis 3090 and the X'-axis 3070. The Y'-axis 3080 is positive towards the crown 110 and negative towards the sole 112. The Z'-axis 3090 extends front-to-rear, parallel to the ground plane and is orthogonal to both the X'-axis 3070 and the Y'-axis 3080. The Z'-axis 3090 is positive towards the strike face 102 and negative towards the rear 111.

The term or phrase "moment of inertia" (hereafter "MOI") can refer to values measured about the CG 199. The term "MOIxx" can refer to the MOI measured in the heel-to-toe direction, about the X'-axis 3070. The term "MOIyy" can refer to the MOI measured in the sole-to-crown direction, about the Y'-axis 3080. The term "MOIzz" can refer to the MOI measured in the front-to-back direction, about the Z'-axis 3090. The MOI values MOIxx, MOIyy, and MOIzz determine how forgiving the club head 100 is for off-center impacts with a golf ball.

"Driver" or "Driver-type" club heads, as used herein, comprise a loft angle less than approximately 16 degrees, less than approximately 15 degrees, less than approximately 14 degrees, less than approximately 13 degrees, less than approximately 12 degrees, less than approximately 11 degrees, or less than approximately 10 degrees. Further, in many embodiments, "driver golf club heads" as used herein comprises a volume greater than approximately 400 cc, greater than approximately 425 cc, greater than approximately 445 cc, greater than approximately 450 cc, greater than approximately 455 cc, greater than approximately 460 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the driver can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

"Fairway wood" or "fairway wood-type" club heads, as used herein, comprise a loft angle less than approximately 35 degrees, less than approximately 34 degrees, less than approximately 33 degrees, less than approximately 32 degrees, less than approximately 31 degrees, or less than approximately 30 degrees. Further, in some embodiments, the loft angle of the fairway wood club heads can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in other embodiments, the loft angle of the fairway wood can be between 12 degrees and 35 degrees, between 15 degrees and 35 degrees, between 20 degrees and 35 degrees, or between 12 degrees and 30 degrees.

Further, "fairway wood" or "fairway wood-type" club heads as used herein can comprise a volume less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In some embodiments, the volume of the fairway wood can be approximately 100 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250-350 cc, or approximately 275-375 cc.

"Hybrid" or "hybrid-type" club heads, as used herein, comprise a loft angle less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the hybrid can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

Further, "hybrid" or "hybrid-type" as used herein comprise a volume less than approximately 200 cc, less than approximately 175 cc, less than approximately 150 cc, less than approximately 125 cc, less than approximately 100 cc, or less than approximately 75 cc. In some embodiments, the volume of the hybrid can be approximately 100 cc-150 cc, approximately 75 cc-100 cc, approximately 100 cc-125 cc, or approximately 75 cc-125 cc.

The golf club heads described in this disclosure can be formed from a metal, a metal alloy, a composite, or a combination of metals and composites. For example, the golf club head can be formed from, but not limited to, steel, steel alloys, stainless steel alloys, nickel, nickel alloys, cobalt, cobalt alloys, titanium alloys, an amorphous metal alloy, or other similar materials. For further example, the golf club head can be formed from, but not limited to, C300 steel, C350 steel, 17-4 stainless steel, or T9s+ titanium.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

DETAILED DESCRIPTION

I. General Description of a Golf Club Head

Referring to the drawings, wherein like reference numerals are used to identify like or identical components in various views, FIGS. 1-3 schematically illustrate a wood-type golf club head 100 in various views. Specifically, FIG. 1 illustrates a front perspective view of a wood-type club head 100. Although the features described herein are illustrated on a fairway wood, it should be noted that any feature, including the slit and flexure insert, can be applied to a driver or hybrid-type club head. The club head 100 can comprise a strike face 102 and a body 101 secured together to define a substantially closed/hollow interior cavity 107. The club head 100 comprises a crown 110, a sole 112 opposite the crown 110, a heel 104, a toe 106 opposite the heel 104, a front 108, and a rear 111 opposite the front 108. The body 101 can further include a skirt 114 located between and adjoining the crown 110 and the sole 112, the skirt 114 extending from near the heel 104 to near the toe 106 of the club head 100.

The strike face 102 and the body 101 can define an internal cavity 107 (shown in further figures below) of the club head 100. The body 101 can extend over the crown 110, the sole 112, the heel 104, the toe 106, the rear 111, and a perimeter of the front 108. In these embodiments, the strike face 102 can be located solely on the front 108 of the club head 100. In other embodiments, the strike face 102 can extend over the perimeter of the front 108 and can form a forward portion of at least one of the crown 110, the sole 112, the heel 104, and the toe 106. In such embodiments, the club head 100 can resemble a "cup face" or "face wrap" design. The strike face 102 comprises a striking surface 113 configured to impact a golf ball, and a back face (illustrated in later embodiments) opposite the striking surface 113.

As illustrated in FIGS. 1-3, the club head 100 comprises a hosel structure 105. The hosel structure 105 is capable of receiving a golf shaft (not shown). In many embodiments, the hosel structure 105 can further comprise a hosel sleeve 116, wherein the hosel sleeve 116 can be coupled to an end of the golf shaft. In such embodiments, the hosel sleeve 116 can be coupled with the hosel structure 105 in a plurality of configurations, thereby permitting the golf shaft to be secured to the hosel structure 105 at a plurality of angles. In such embodiments, the hosel sleeve 116 can provide the club head 100 with loft angle and/or lie angle adjustability.

In many embodiments, the club head 100 can comprise a multi-material design. The strike face 102 can be formed from a metal material, and the body 101 can be formed from one or more metals or non-metal materials. In such embodiments, the body 101 can comprise a metallic first component 118 and a non-metallic second component 119. As illustrated in FIG. 1, the club head 100 can comprise a wrap-around non-metallic design such that the second component 119 forms portions of the crown 110, skirt 114, heel 104, toe 106, and sole 112. In other embodiments, the club head 100 can comprise any other multi-material design, wherein the non-metallic second component 119 can form any portion of the strike face 102, crown 112, skirt 114, heel 104, toe 106, and/or sole 112. Providing the club head 100 with a multi-material design can increase discretionary mass that can be redistributed throughout the club head 100 to improve mass properties such as MOI or CG 199 position. In other embodiments, the club head 100 can comprise a single-material design wherein the body 101 is all formed of the same or similar material.

II. General Description of a Slit

Figure 4:
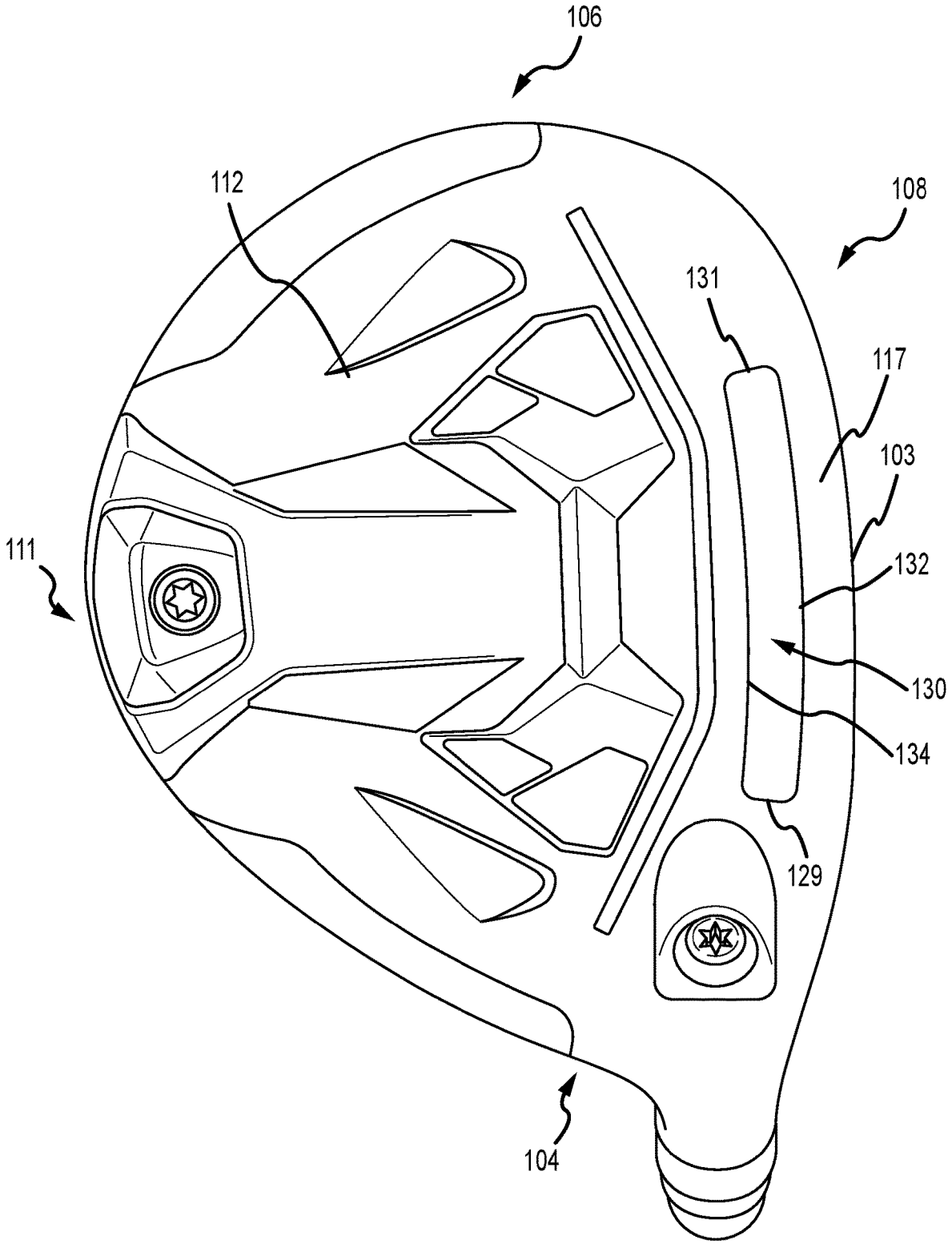
FIG. 4 illustrates a sole view of the wood-type club head of FIG. 1 devoid of the flexure insert.
Figure 5:
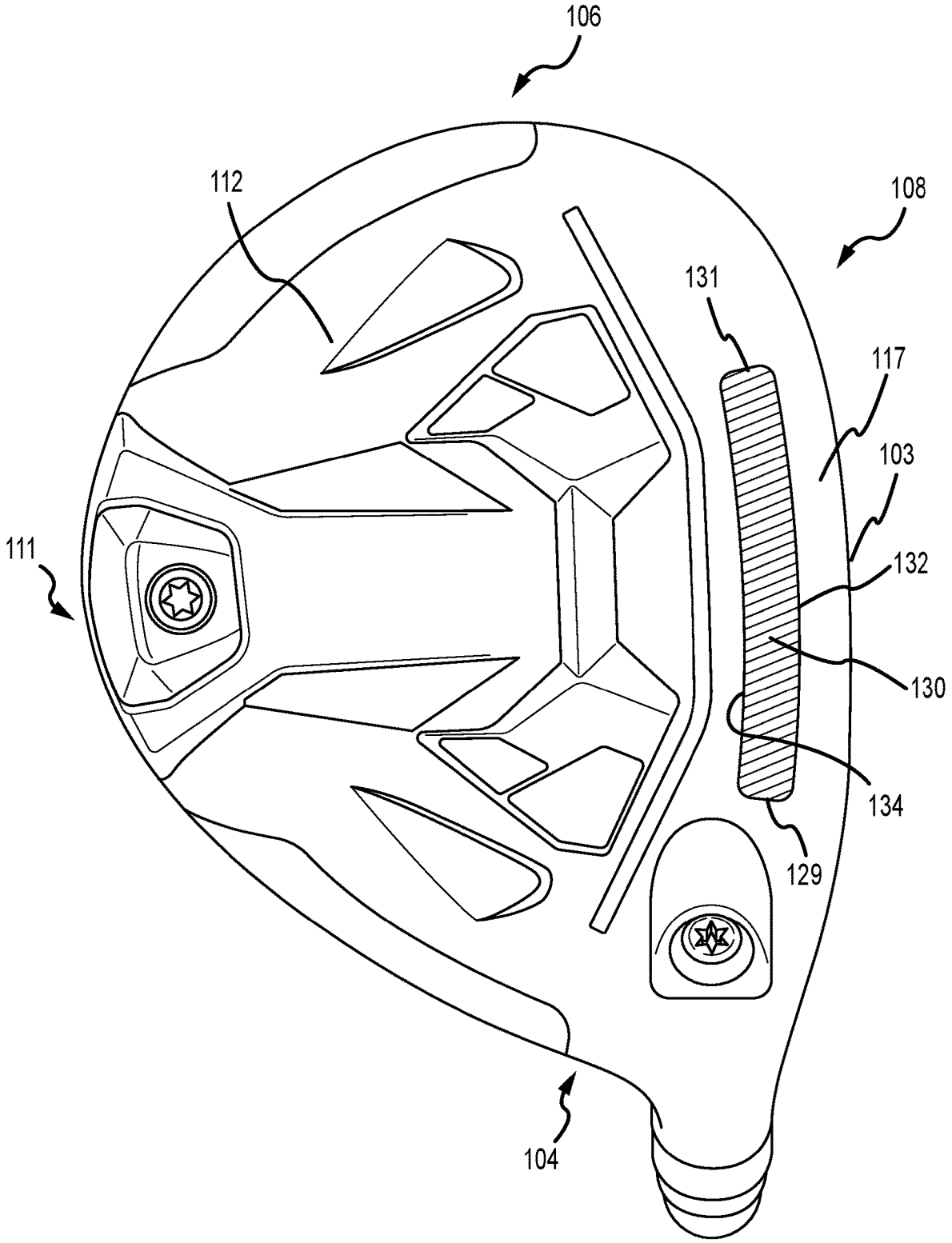
FIG. 5 illustrates a sole view of the wood-type club head of FIG. 1.
Figure 6:
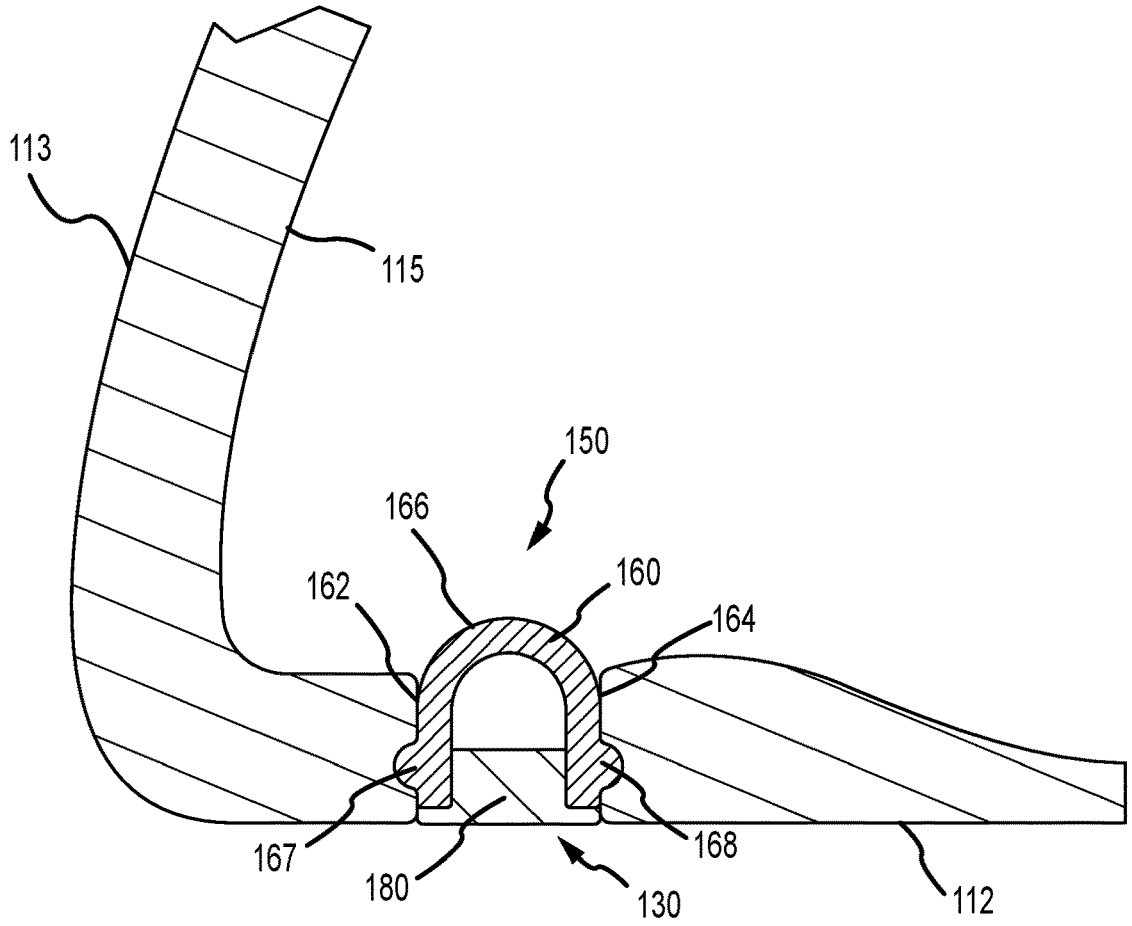
FIG. 6 illustrates a detailed cross-sectional view of the wood-type club head comprising a slit and a flexure insert according to a first embodiment.
Figure 7:
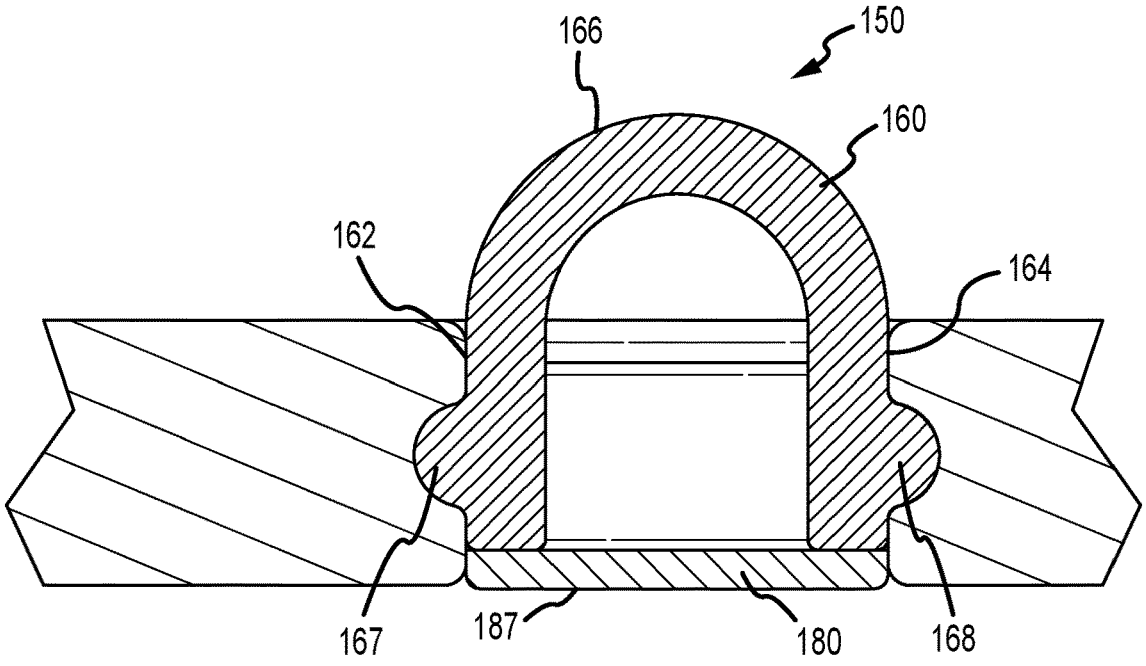
FIG. 7 illustrates a detailed cross-sectional view of the wood-type club head of FIG. 6 comprising the slit and flexure insert according to the first embodiment.

Referring to FIGS. 4 and 5, the club head 100 comprises a slit 130 configured to receive a flexure insert 150. The slit 130 can be a through slit 130 that communicates between the exterior of the club head 100 and the interior cavity 107. In many embodiments, the slit 130 is located on the sole 112, however in other embodiments, the club head 100 can comprise one or more slits in the sole 112, heel 104, toe 106, skirt 114, crown 110, or any combination thereof. Referring to the illustrated embodiment of FIG. 4, the slit 130 can be an opening in the sole 112 that extends across a portion of the sole 112 in a heel-to-toe direction. The slit 130 provides a strategic weakness in the sole 112, wherein the sole 112 is more flexible than a sole devoid of a slit 130. The slit 130 therefore encourages the club head body 101 to flex. The slit 130 can comprise a forward edge 132 adjacent the strike face 102, and a rearward edge 134 opposite the forward edge 132, wherein the forward edge 132 and the rearward edge 134 define the boundaries of the slit 130. The slit 130 further comprises a heel end 129 and a toe end 131 opposite the heel end 129. The forward edge 132 and the rearward edge 134 can extend between the heel end 129 and the toe end 131.

In many embodiments, the slit 130 can be located proximate to the strike face 112, and can be separated from the leading edge 103 by a forward sole portion 117. By proximity to the strike face 112, the slit 130 increases strike face 102 flexure at impact. Further, the slit 130 being proximate the strike face 102 can increase dynamic loft and/or reduce spin. Details of the slit 130 location, shape, and geometry are discussed further below.

Described herein are various embodiments of golf club heads comprising a slit 130 to improve the bending of the strike face 120. The sole 112 defines the slit 130. The slit 130 is configured to retain a flexure insert 150. Although the dimensions, characteristics, and features of the slit 130 are described in relation to club head 100, any slit 130, 230, 330, 430, 530, 630, 730, 930, 1030, 1130, 1230, 1330, 1430, 1530, 1630, 1730, 1830 described herein can be combined with any club head embodiment described herein. For example, any of the flexure inserts 150, 250, 350, 450, 550, 650, 750, 950, 1050, 1150, 1250, 1350, 1450, 1550, 1650, 1750, 1850 described in the embodiments below can be applied to any slit geometry described herein. Any of the flexure insert embodiments described above can be applied to a basic slit 130, wherein the slit 130 is devoid of any retaining walls or complex geometries. In other embodiments, any of the flexure inserts described above can be applied to a slit 130 comprising one or more retaining walls or other features described and illustrated in the following embodiments. In some embodiments, one or more retaining walls or other slit 130 geometries can complement the flexure insert 150 by providing further control over the flexure of the strike face 152 or by helping to retain the flexure insert 150 within the slit 130.

As described above and illustrated in FIGS. 4 and 5, illustrates the sole 112 of the club head 100 defines the slit 130. The slit 130 can be a through slit 130, such that the slit 130 provides an opening between the exterior of the club head 100 and the interior cavity 107. In many embodiments, the slit 130 is located proximate the strike face 102. The slit 130 comprises a forward edge 132 adjacent the strike face 102, and a rearward edge 134 opposite the forward edge 132. In many embodiments, the slit 130 is located in a forward portion of the sole 112, closer to the front end 108 than the rear 111. Referring to FIG. 4, the slit 130 can be spaced from the leading edge 103 of the strike face 102 by a forward sole portion 117. The slit 130 extends across the sole 112 in a heel-to-toe direction.

The slit 130 strategically weakens sole 112 proximate the strike face 102, allowing the strike face 102 to bend at impact. Accordingly, the slit 130 provides improved strike face 102 bending dynamics to provide beneficial golf ball performance characteristics such as increased speed, higher launch, and lower spin. As described in more detail below, the sole 112 can define various slit 130 embodiments to improve the flexure of the strike face 102.

The geometry and dimensions of the slit 130 are significant in determining the nature of the strike face 102 flexure at impact. The size, shape, and location of the slit 130 when viewed from the sole, as illustrated by FIG. 4, can be defined as the "profile" of the slit 130. The slit 130 profile can impact the overall amount the strike face 102 flexes as well as how much individual portions of the strike face 102 flex relative to one another (i.e. whether the strike face 102 flexes closer to the geometric center 120 than near the strike face 102 perimeter, etc.).

Figure 28:
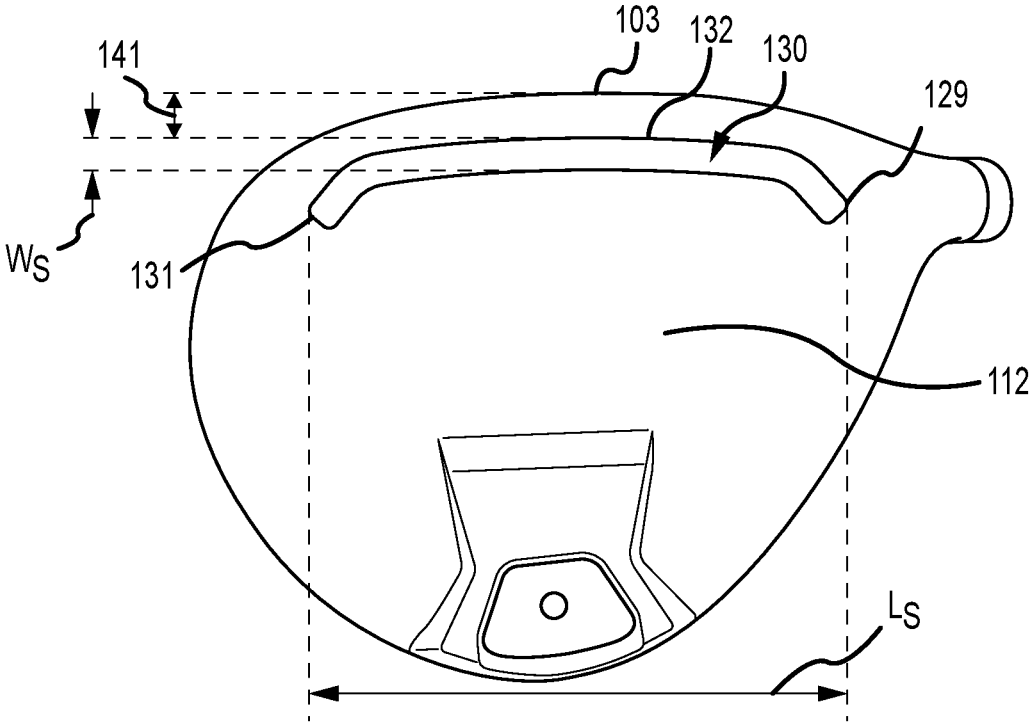
FIG. 28 illustrates a sole view of a wood-type club head comprising a slit extending in a heel to toe direction.

Referring to FIG. 28, the slit profile can be characterized by slit offset distance 141 measured from the leading edge 103 of the club head 100 to the slit forward edge 132. The slit offset distance 141 is measured from the club head leading edge 103 to the slit forward edge 132. In many embodiments, the slit offset distance 141 can be less than 20 mm. In some embodiments, the slit offset distance 141 can be less than 15 mm, 10 mm, or 5 mm. In some embodiments, the slit offset distance 141 can be approximately 20 mm, 15 mm, 14 mm, 13 mm, 12 mm, 11 mm, 10 mm, 9 mm, 8 mm, 7 mm, 6 mm, or 5 mm.

The slit 130 profile can further be characterized by a slit width and a slit length. The width of the slit can be measured as a transverse width between the forward edge and the rearward edge. In many embodiments, the width of slit can range from 3.5 mm to 10 mm. In some embodiments, the width of the slit can be approximately 3.5 mm, 3.8 mm, 4.0 mm, 4.5 mm, 5.0 mm, 5.5 mm, 6 mm, 6.5 mm, 7 mm, 7.5 mm, 8 mm, 8.5 mm, 9 mm, 9.5 mm, or 10 mm. The slit length can be measured as a distance between a heel most point of the slit 130 to a toe most point of the slit 130, measured parallel to the X-axis 1040. In many embodiments, the length of slit 130 can range from 70 mm to 90 mm. In some embodiments, the length of the slit can be approximately 70 mm, 75 mm, 80 mm, 85 mm, or 90 mm.

The slit 130 profile can be further characterized by the shape of the slit 130. The slit 130 can be an elongated slit 130 extending across the sole 112 in a heel-to-toe direction. FIG. 28 illustrates an elongated slit 130 embodiment. The slit 130 can comprise a heel end 219 and a toe end 131. The heel end 129 and the toe end 131 can comprise rounded ends.

In some embodiments, the heel end 129 and the toe end 131 of the slit 130 can be angled with respect to the center of the slit 130. The heel end 129 and toe end 131 of the slit 130 can be angled rearward toward the rear 111 of the club head 101. The angled toe end 129 and heel end 131 of the slit 130 increases the length $L_s$ of the slit 130 in the heel-to-toe direction. The heel end 129 and the toe end 131 of the slit 130 can extend rearward the strike face 102. Described in another way, a portion of a forward edge 132 of the slit 130 can be parallel with the strike face 102, while other portions of the slit forward edge 132 are non-parallel. The orientation of the slit forward edge 132 contributes to lengthening the slit 130, thereby increasing the flexure of the sole 112. Increasing the length $L_s$ of the slit 130 increases the flexure of the sole 112. The angled heel end 129 and toe end 131 may also help secure the flexure insert within the slit 130.

Furthermore, the angle of the heel end 129 and the toe end 131 can aid in reducing overall stress that the slit 130 experiences. Due to the geometry of the elongated slit 130, the club head 100 experiences a buildup in stress at the ends 129, 131 upon impact with the golf ball. At impact, the forward edge 132 of the slit 130 deflects rearwardly, more so than at the center. When the slit 130 deflects, stress builds up at the toe end 129 and heel end 131. The angle of the heel end 129 and toe end 131 allow for more mass to be placed around the ends of the slit 130 to be able to withstand the stress buildup.

In other embodiments, the slit 130 profile can comprise other shapes and geometries to increase the flexure and durability of the slit 130. For example, the heel end 129 and toe end 131 can comprise a greater angle. The center of the slit 130 may also be angled or curved with respect to the leading edge. The heel end 129 and toe end 131 may also comprise a greater width or more rounded ends, similar to a dumbbell shape.

III. Flexure Inserts

As discussed above and as illustrated in FIG. 5, the club head 100 further comprises a flexure insert 150 configured to be inserted into the slit 130. The flexure insert 150 serves multiple functions. The flexure insert 150 fills the opening created by the slit 130 to seal the interior cavity 107. The flexure insert 150 also provides resistance against over-bending of the slit 130 during impact. The amount the slit 130 bends at impact can be related to the stiffness of the flexure insert 150. The stiffer the flexure insert 150, the less the slit 130 flexes at impact. The flexure insert 150 can be designed to provide the greatest amount of slit 130 bending possible without risking over-bending to the point of failure. The flexure insert 150 can improve the durability of the slit 130 so that the walls surrounding the slit 130 may be thinner. The flexure insert 150 may also allow for the strike face to be made thinner. In some embodiments, the flexure insert 150 can comprise a variable stiffness at different points along the slit 130. In such embodiments, the flexure insert 150 can provide more precise control over the strike face 102 flexure.

The flexure insert 150 can comprise various configurations to adjust the overall stiffness of the slit 130 to achieve a desired flexure and support of the slit 130. In some embodiments, the flexure insert 150 can be stiffer near the center of the slit 130 than the near the heel end 129 or the toe end 131. In other embodiments, the flexure insert 150 can be stiffer near the heel end 129 or the toe end 131 if desired. Furthermore, the degree of stiffness of the flexure insert 150 can also be adjusted to provide a desired flexure and support of the slit 130. As such, the flexure insert 150 may be customized or specifically designed to adjust the overall performance of the slit 130 to achieve a desired flexure and support by targeting specific areas of the slit 130 to be stiffer or by adjusting the stiffness of the flexure insert 150 itself.

The stiffness of the flexure insert 150 can be adjusted by providing the flexure insert 150 with at least two materials. The flexure inserts described herein comprise at least two materials. The first material can comprise a first stiffness value and the second material can comprise a second stiffness value different the first. The first material and second material be arranged in any configuration to provide a desired stiffness profile of the slit, as described above.

In many embodiments, as illustrated and described below, the flexure insert 150 can comprise a spring component 160 and a cap 180. The flexure insert 150 is a separate component formed from a different material than the strike face 102 and the body 101. The flexure insert 150 is not integral (i.e. not formed from a same material as the sole 112) with the club head 100. The spring component 160 acts like a brace or support structure that prevents the slit 130 from over flexing to the point of failure. The spring component 160 can further aid in increasing internal energy of the club head 100 upon impact with the golf ball. The spring component 160 stores energy when it is compressed during impact and returns energy upon expansion thereby increasing overall performance of the slit 130. The spring component 160 provides improvement over previously used inserts by returning more energy back into the club head. The spring component functions in a linear-elastic manner while previously used inserts (polymeric and similar inserts) function in a viscoelastic manner. Viscoelastic compression will result in energy loss when compared to a linear elastic compression. Viscoelastic compressions absorb and dissipate energy such that energy does not return back into the system, resulting in a significant energy loss. The spring component 160 can comprise a plastic, composite, a spring steel, a titanium, or any other material which provides sufficient linear elastic compression. The linear elastic compression returns a majority, if not all, of the energy back into the system and club head, resulting in an increase in energy. The cap 180 seals the interior cavity 107 of the club head 100. The cap 180 can be formed from a polymer material. The cap 180 fills the remaining space of the slit 130 to close off communication between the exterior of the club head 100 and the interior cavity 107.

During a golf ball impact, the slit 130 allows the club head body 101 to flex more than a club head sole devoid of a slit 130. However, if the slit 130 flexes too much, this over flexing of the slit 130 will lead to cracks and failure. To prevent over flexing, the flexure insert 150 braces or supports the slit 130 as the sole 112 flexes under the impact of the golf ball. The flexure insert 150 prevents the sole 112 from over flexing during the golf ball impact thereby improving club head durability. Improved club head durability allows the club head 100 to achieve desirable strike face 102 flexing to increase ball speed, spin, and/or distance. In some embodiments, the flexure insert 150 can reduce the need for sole walls built up and around the slit 130. Additional built-up walls provide unnecessary weight additions in the forward sole portion that negatively affect MOI properties and CG location. Furthermore, the sole walls directly around the slit can be made thinner which will increase flexure and ball speed while also providing an increase in discretionary mass. The slit 130 and flexure insert 150 of the present invention provides maximum flexure of the strike face 102 and sole 112 while improving golf ball performance (e.g. ball speed, spin, and distance).

The flexure insert 150 comprising a spring component 160 provides performance benefits in comparison to traditional inserts devoid of a spring component. Traditional inserts are made of uniform viscoelastic materials which dissipate energy at impact rather than returning energy to the strike face 102. In comparison, the flexure insert 150 comprises a linearly elastic spring component 160 which efficiently stores and returns internal energy at impact, increasing ball speed and the overall internal energy of the club head.

In many embodiments, the flexure insert 150 comprising a spring component 160 can lead to an increase of internal energy at impact over a club head comprising an insert devoid of a spring component by between 3 lbf-in. and 25 lbf-in. In many embodiments, the increase in internal energy at impact can be between 3 and 5 lbf-in., between 5 and 10 lbf-in., between 10 and 15 lbf-in., between 15 and 20 lbf-in., or between 20 and 25 lbf-in. In many embodiments, the increase in internal energy at impact can be approximately 3 lbf-in., approximately 4 lbf-in., approximately 5 lbf-in., approximately 6 lbf-in., approximately 7 lbf-in., approximately 8 lbf-in., approximately 9 lbf-in., approximately 10 lbf-in., approximately 11 lbf-in., approximately 12 lbf-in., approximately 13 lbf-in., approximately 14 lbf-in., approximately 15 lbf-in., approximately 16 lbf-in., approximately 17 lbf-in., approximately 18 lbf-in., approximately 19 lbf-in., approximately 20 lbf-in., approximately 21 lbf-in., approximately 22 lbf-in., approximately 23 lbf-in., approximately 24 lbf-in., or approximately 25 lbf-in.

Likewise, in many embodiments, the flexure insert 150 comprising a spring component 160 can lead to an increase in ball speed at impact (measured at a club head speed of 100 mph) over a club head comprising an insert devoid of a spring component by between 0.5 mph and 4.5 mph. In many embodiments, the increase in ball speed at impact can be between 0.5 mph and 1.0 mph, between 1.0 mph and 1.5 mph, between 1.5 mph and 2.0 mph, between 2.0 mph and 2.5 mph, between 2.5 mph and 3.0 mph, between 3.0 mph and 3.5 mph, between 3.5 mph and 4.0 mph, or between 4.0 mph and 4.5 mph. In some embodiments, the increase in ball speed at impact can be approximately 0.5 mph, approximately 0.6 mph, approximately 0.7 mph, approximately 0.8 mph, approximately 0.9 mph, approximately 1.0 mph, approximately 1.1, approximately 1.2 mph, approximately 1.3 mph, approximately 1.4 mph, approximately 1.5 mph, approximately 1.6 mph, approximately 1.7 mph, approximately 1.8 mph, approximately 1.9 mph, approximately 2.0 mph, approximately 2.1 mph, approximately 2.2 mph, approximately 2.3 mph, approximately 2.4 mph, approximately 2.5 mph, approximately 2.6 mph, approximately 2.7 mph, approximately 2.8 mph, approximately 2.9 mph, approximately 3.0 mph, approximately 3.1 mph, approximately 3.2 mph, approximately 3.3 mph, approximately 3.4 mph, approximately 3.5 mph, approximately 3.6 mph, approximately 3.7 mph, approximately 3.8 mph, approximately 3.9 mph, approximately 4.0 mph, approximately 4.1 mph, approximately 4.2 mph, approximately 4.3 mph, approximately 4.4 mph, or approximately 4.5 mph.

IV. General Description of a Multi-Material Flexure Insert

As described in more detail below, the club head 100 comprises a flexure insert 150 configured to be inserted within the slit 130. In one embodiment, the flexure insert 150 can comprise a spring component 160 and a cap 180. The spring component 160 is configured to limit the flexure of the slit 130 during a golf ball impact while also increasing internal energy of the club head 100. The cap 180 is configured to seal the interior cavity 107 of the club head 100. The spring component 160 can be formed from a polymer, plastic, composite, a spring steel, or a titanium. The cap 180 can be formed from a polymer or plastic material.

In many embodiments, the spring component 160 is positioned in the center of the slit 130. In other embodiments, the spring component 160 can be positioned near the heel end 129 of the slit 130, near the center of the slit 130, near the toe end 131 of the slit 130, or any combination thereof. Typically, the middle of the sole 112 near the strike face 102 experiences a greater amount of flexing compared to portions of the sole 112 near the heel 104 or toe 106. In many embodiments, the spring component 160 is positioned near the center of the slit 130, where the sole 112 experiences the greatest amount of flexing.

The flexure insert 150 can comprise one spring component 160. In other embodiments, the flexure insert can comprise one, two, or three spring components 160. For embodiments comprising two spring components (not shown), a first spring component can be positioned near the center of the slit 130, and the second spring component can be positioned near the heel end 129 or near the toe end 131 of the slit 130. For embodiments comprising three spring components, a first spring component can be positioned into the central portion of the slit 130, a second spring component can be positioned near the heel end 129 of the slit 130, and a third spring component can be positioned near the toe end 131 of the slit 130.

Similar to a spring, the spring component 160 stores energy upon compression in a linear elastic manner. The spring component 160 of the flexure insert 150 undergoes compression upon impact of the golf ball. Upon impact, the forward edge 132 of the slit 130 flexes, or translates rearwardly, thereby compressing the flexure insert 150. The spring component 160 will both limit the amount of translation or flexion of the forward edge 132 of the slit 130 to prevent failure and increase energy returned back to the slit 130 while decompressing. In other words, the spring component 160 limits flexing of the slit 130 but will push, or spring, the slit 130 back to original shape, improving performance and durability. This provides improved structural integrity and an increase an internal energy over a viscoelastic polymeric insert.

The spring component 160 comprises a first material. The first material may be selected from the group consisting of: plastic, composite thermoset, steel, stainless steel, spring steel, titanium, and aluminum.

The spring component 160 further comprises a first modulus of elasticity value. In some embodiments, the first modulus of elasticity value can range from approximately 20 to 210 GPa. For example, the first modulus of elasticity value can range from approximately 20-70 GPa, 70-120 GPa, 120-170 GPa, or 170-210 GPa.

As discussed above, the flexure insert 150 comprises a cap 180 configured to seal the interior cavity 157 of the club head. The cap 180 can extend across the entirety of the profile of the slit 160 heel end 129 to the toe end 131 and from the forward edge 132 to the rearward edge 134 of the slit 130. The cap 180 closes off the slit 130 and separates the interior cavity 107 from the exterior of the club head 100. The cap 180 can comprise a cap exterior surface 188 that forms a portion of the sole 112 at the slit 130. The cap 180 blocks water and debris from entering the hollow interior cavity 107 and may also provide structural support to the slit 130 to assist in preventing the slit 130 from over flexing.

As described above, the flexure insert 150 comprises a cap 180 in addition to the spring component 160. The cap 180 comprises a second material. The second material may be an injected molded polymer such as TPE, TPU, silicon, butyl rubber, foam metal, or any other suitable material or combination thereof.

The cap 180 further comprises a second modulus of elasticity value. In some embodiments, the second modulus of elasticity value can range from approximately 0.1 GPa to 30 GPa. For example, the second modulus of elasticity value can range from approximately 0.1 to 1 GPa, 1 to 5 GPa, 5 to 10 GPa, 10 to 20 GPa, or 20 to 30 GPa. In other embodiments, the spring component may comprise a modulus of elasticity of at least 30 GPa, at least 31 GPa, at least 32 GPa, at least 33 GPa, at least 33 GPa, at least 34 GPa, at least 35 GPa, at least 40 GPa, at least 45 GPa, at least 50 GPa, at least 60 GPa, at least 70 GPa, at least 80 GPa, at least 90 GPa, or at least 100 GPa. The spring component 160 comprises a greater modulus of elasticity value than the cap 180 such that the first modulus of elasticity value is greater than the second modulus of elasticity value.

In many embodiments, and as illustrated in the embodiments in FIGS. 6-27, the spring component 160 and the cap 180 combine to form a unitary flexure insert 150. In many embodiments, the spring component 160 can be partially embedded or entirely embedded within the cap 180. In many embodiments, a bottom portion of the spring component 160 can be embedded within the cap 180. In such embodiments, the cap 180 covers the entire bottom portion of the spring component 160, such that no portion of the spring component 160 is exposed to the exterior of the club head 100. In other embodiments, the bottom portion of the spring component 160 may not be entirely embedded within the cap 180, such that at least a portion of the spring component 160 is exposed to the exterior of the club head 100. In many embodiments, only a bottom portion of the spring component 160 can be embedded within the cap 180 while a top portion of the spring component 160 is exposed to the hollow interior cavity 107. In many embodiments, described in further detail below, the spring component 160 can be entirely embedded within the cap 180, such that no portion of the spring component 160 is exposed to either the exterior of the club head 100 or the hollow interior cavity 107.

As described above, the flexure insert 150 provides multiple benefits. The flexure insert 150 seals the interior cavity 107, reinforces the slit 130, and prevents over flexing of the slit 130. Specifically, the multi-material flexure insert 150 comprising a spring component 160 and a cap 180 can provide performance benefits over a traditional insert. The spring component 160 creates a spring effect that increases the internal energy transferred between the club head 100 and the golf ball, improving golf ball performance (i.e. ball speed, spin, and distance).

a. Flexure Insert with U-Shaped Spring Component

FIGS. 6-9 illustrate an embodiment of a golf club head comprising a slit 130 and a flexure insert 150, wherein the flexure insert 150 comprises a U-shaped spring component 160. The U-shaped spring component comprises a front wall 162, a rear wall 164, and a top wall 166. The top wall 166 connects the front wall 162 and the rear wall 164. The top wall 166 extends in a curved manner into the interior of the club head, providing the U-shape appearance.

The front wall 162 and the rear wall 164 are configured to abut the front surface and the rear surface of the slit 130, respectively. In other embodiments, the front wall 162 and rear wall 164 may be offset from the front surface and rear surface of the slit. The front wall 162 and the rear wall 164 of the spring component 160 comprise a front protrusion 167 and rear protrusion 168 extending forward and rearwardly, respectively. The front and rear protrusions 167, 168 are configured to be received in a front recessed portion 140 and rear recessed portion 142, respectively. The protrusions 167, 168 allow for the spring component 160 to be secured within the slit 130. In other embodiments, the spring component 160 may have any number of other protrusions. For example, the spring component 160 may lack protrusions, the spring component 160 may have one protrusion, or the spring component 160 may have three or more protrusions.

Figure 8:
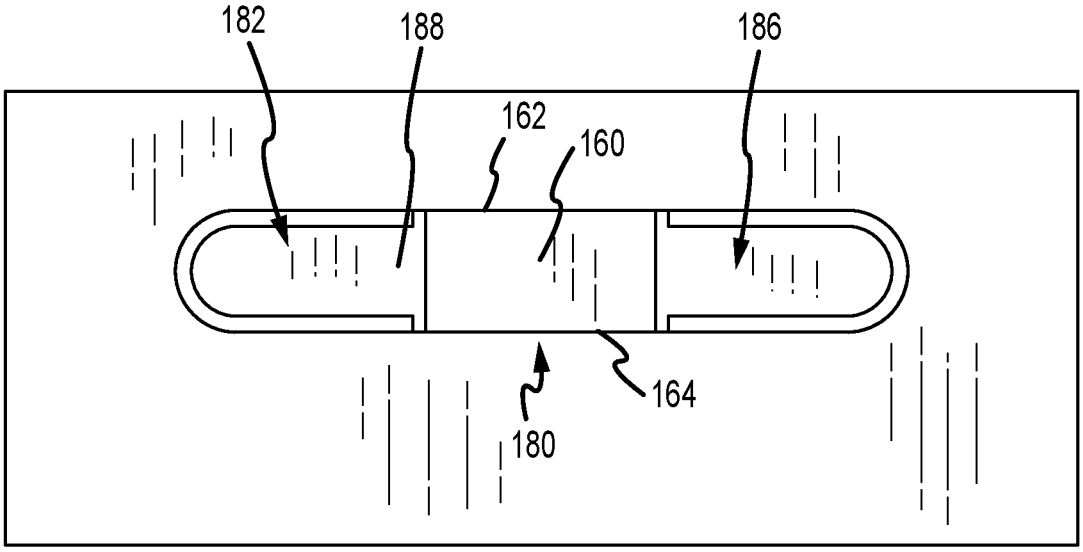
FIG. 8 illustrates a top internal cavity view of the slit and flexure insert of FIG. 6.
Figure 9:
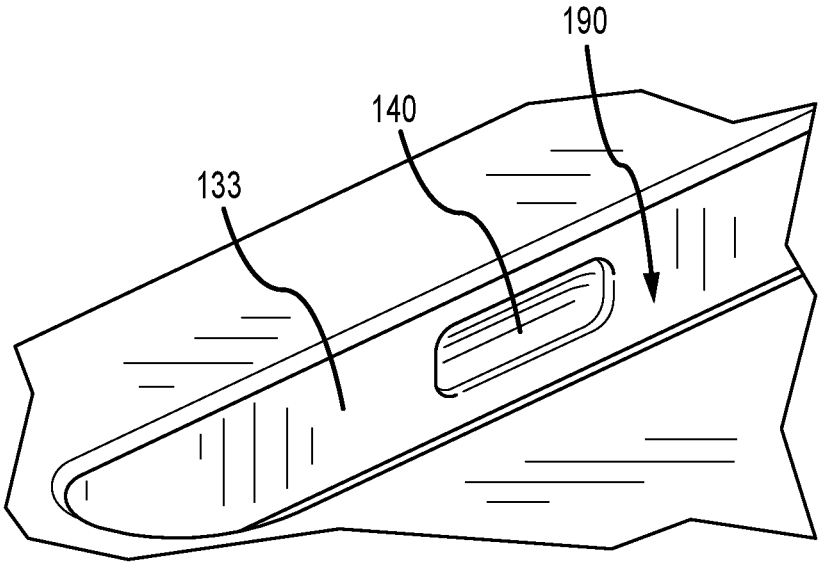
FIG. 9 illustrates a perspective internal cavity view of the slit of FIG. 6 devoid of the flexure insert.

As illustrated in FIG. 8, the spring component 160 is located within the central portion 190 of the slit 130 such that the heel and toe portions are devoid of the spring component 160. As mentioned above, the spring component 160 targets the central portion 190 of the slit 130 because the central portion 190 of the slit 130 experiences the highest deflection upon impact with a golf ball.

Upon impact with a golf ball, the front surface of the slit 130 deflects backwards, pushing the front wall 162 of spring component 160 rearward and closer to the rear wall 164. The top wall 166 of the spring component 160 will bend, due to the curved shape, loading the spring component 160 and storing internal energy. Once the spring component 160 has reached max compression and bending, the front wall 162 will spring forward, returning the front surface of the slit 130 back to the pre-impact position.

The spring component 160 comprises a length $L_{sc}$ that is the distance from the heel most point of the spring component 160 to the toe most point of the spring component 160. In this embodiment, the spring component length $L_{sc}$ is approximately 0.20 inches. In other embodiments, the spring component length $L_{sc}$ can range from approximately 0.10 inches to 1.50 inches. The spring component length $L_{sc}$ can also be expressed as a percentage of the total slit length $L_s$. The spring component length $L_{sc}$, in the illustrated embodiment, is approximately 32% of the total slit length $L_s$. In other embodiments, the spring component length $L_{sc}$ can range from approximately 10% to 50% of the total slit length $L_s$.

The flexure insert 150 further comprises a cap 180. In this embodiment, the cap 180 covers the entire slit 130 and covers the spring component 160 such that the spring component 160 cannot be viewed from the exterior of the club. The spring component 160 is partially embedded in the cap 180 such that a portion of the spring component 160 can be seen from the interior of the club head. The cap 180 comprises a heel portion 182, a central portion 184, and a toe portion 186. The cap 180 can further comprise a thickness $t_c$ measured from the exterior surface 187 of the cap 180 to the interior surface 188 of the cap 180. In many embodiments, the cap 180 thickness $t_c$ can be greater in the heel portion and the toe portion than in the central portion.

The flexure insert 150 provides an increase in slit durability by stiffening the central portion of the slit. Furthermore, the U-shaped spring component 160 loads under deflection of the slit and stores energy. After maximum deflection occurs, the U-shaped spring component 160 returns energy back into the club head, increasing ball speed, spin, and distance. The U-shaped spring component 160 also prevents failure of the slit by preventing the slit from deflecting to the point of cracking.

In this embodiment, the spring component 160 comprises a U-shaped configuration. In other embodiments, the spring component 160 can comprise other shaped configurations such as a V-shape or W-shaped configurations. In each of these embodiments, a portion of the spring component extends into the interior of the cavity such that a portion of the spring component is not embedded within the cap and can be seen from an interior view of the club head. In each of these embodiments, the spring component 160 contacts both the front and rear wall of the slit.

The geometries of the slit 130 as illustrated in the figures are not to be construed as limiting but rather illustrated as an exemplary embodiment. For example, the width, length, profile, and walls of the slit 130 can be adjusted as desired. Furthermore, the geometries of the flexure insert 150 may also be adjusted so that flexure insert 150 is complimentary to the walls of the slit 130.

b. Flexure Insert with Suspended Spring Component

Figure 10:
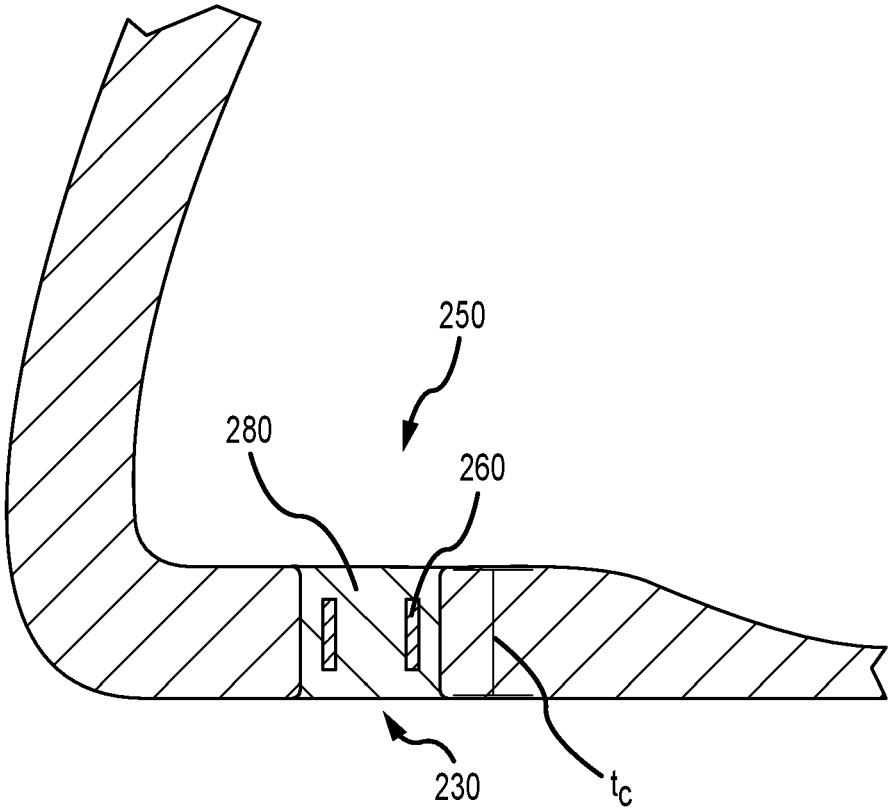
FIG. 10 illustrates a detailed cross-sectional view of the wood-type club head comprising a slit and a flexure insert according to a second embodiment.
Figure 11:
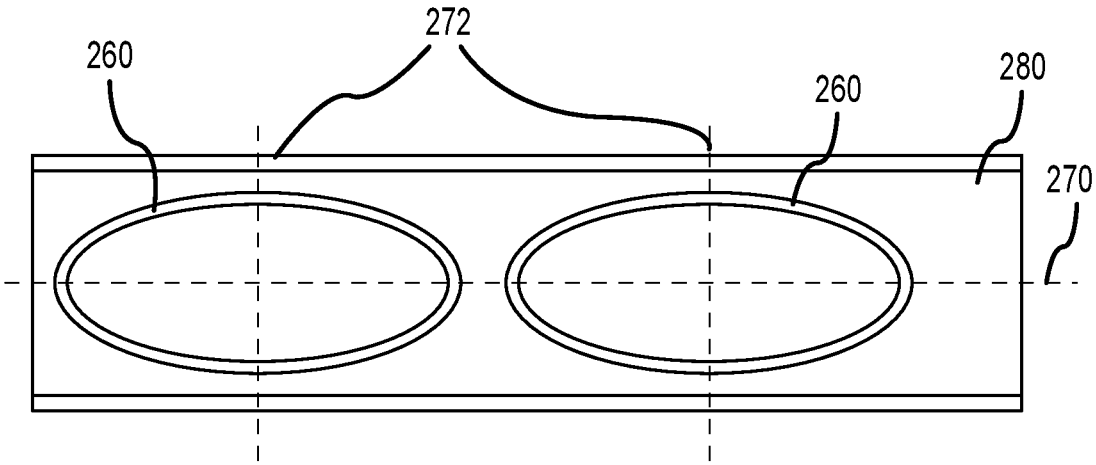
FIG. 11 illustrates a top cross-sectional view of a spring component from the flexure insert of FIG. 10.
Figure 12:
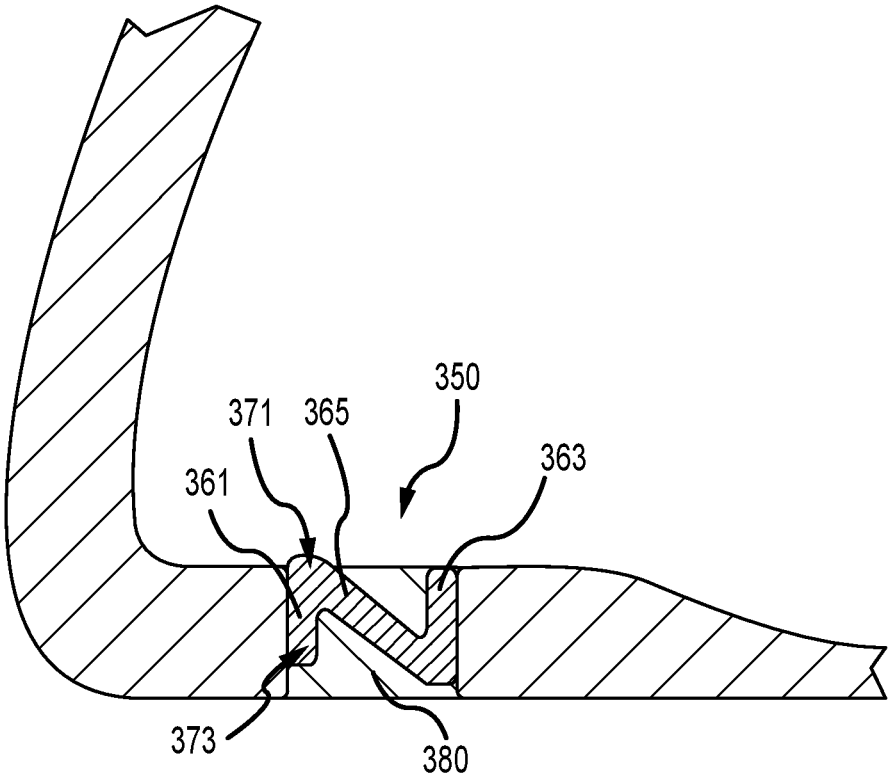
FIG. 12 illustrates a cross-sectional view of the wood-type club head comprising a slit and a flexure insert according to a third embodiment.

FIGS. 10 and 11 illustrates a second embodiment of a club head comprising a slit 230 and a flexure insert 250. The flexure insert 250 comprises a spring component 260. In this embodiment, the spring component 260 is embedded entirely within the cap 280. In other words, the spring component can be suspended within the cap 280. In the embodiment of FIGS. 10-12, the spring component 260 can be spaced from the edges of the slit 230 such that the spring component 260 does not contact the forward surface 233 or the rear surface 235 of the slit 230. In the present embodiment, the spring component 260 is not coupled to the walls of the slit 230. The spring component 260 acts like a "floating spring", wherein the spring component 260 is suspended within the cap 280 and does not contact the walls of the slit 230. As mentioned above, the spring component 260 may be positioned anywhere within the cap 280.

As illustrated in FIGS. 10 and 11, the spring component 260 can comprise an elliptical shape. The elliptical shape comprises a major axis 270 and a minor axis 272. The major axis 270 of the elliptical shape can be aligned in a heel to toe direction within the slit 230, whereas the minor axis 272 of the elliptical shape can be aligned in a front to rear direction. As such, the elliptical spring component 260 can be longer in a heel to toe direction than in a front to rear direction. Further, as illustrated in FIGS. 10 and 11, the flexure insert 250 can comprise a series of elliptical shaped spring components 260 positioned within the slit 230. The elliptical shape allows the spring component 260 to flex during impact. The spring component 260 flexes along the minor axis 272 such that the minor axis distance will decrease. In other embodiments, the club head can comprise a floating spring component 260 that is not necessarily an elliptical shape. In alternative embodiments, the floating spring component can comprise a circular shape, a triangular shape, a rectangular shape, a pill shape, or any other suitable shape. In each of these embodiments, the spring component does not contact the front or rear surface of the slit such that there is a different material between the spring component and the wall of the slit.

As illustrated in FIGS. 10 and 11, the cap 280 can entirely fill the slit 230. The cap 280 can comprise a cap thickness $t_c$. The cap thickness $t_c$ can be equal to the sole thickness at the forward edge of the slit 230. The cap thickness $t_c$ can be equal to the sole thickness at the rearward edge of the slit 230. The elliptical shaped spring component is disposed within the cap 280 such the cap 280 fully surrounds the spring component 260.

In this embodiment, the spring component 260 comprises a continuous perimeter. The continuous perimeter enables the spring component 260 to bend and return back to shape. The spring component may be made into any desirable shape wherein the shape comprises a continuous perimeter. A discontinuity in the perimeter of the embedded spring component will negatively affect the spring components ability to store energy and spring back to shape as the spring component is not rigidly fixed to a wall of the slit.

The geometries of the slit 230 as illustrated in the figures are not to be construed as limiting but rather illustrated as an exemplary embodiment. For example, the width, length, profile, and walls of the slit 230 can be adjusted as desired. Furthermore, the geometries of the flexure insert 250 may also be adjusted so that flexure insert 250 is complimentary to the walls of the slit 230.

c. Flexure Insert with N-Shaped Spring Component

Figure 13:
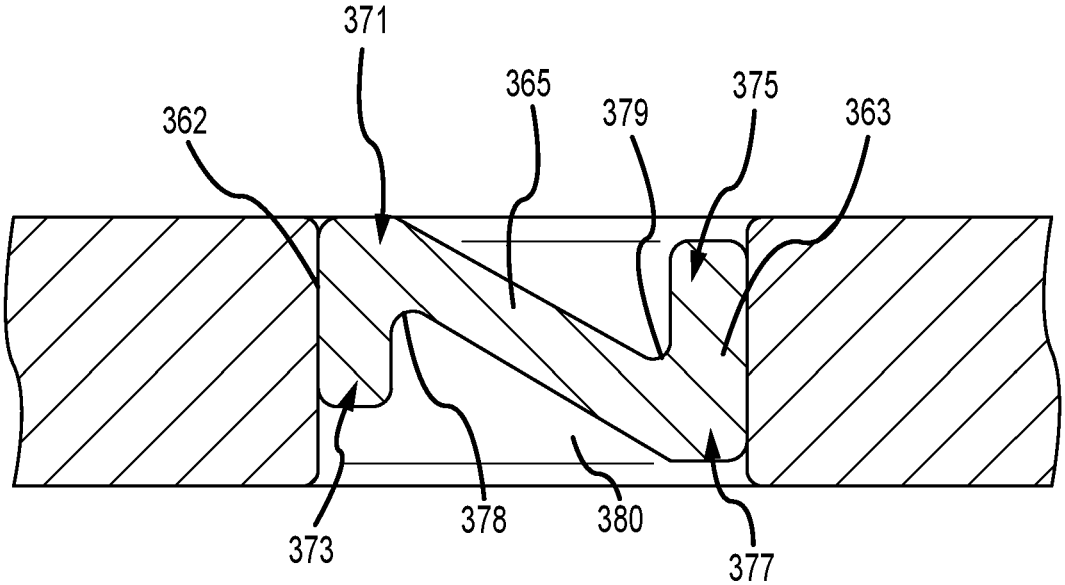
FIG. 13 illustrates a detailed cross-sectional view the slit and flexure insert of FIG. 12.
Figure 14:
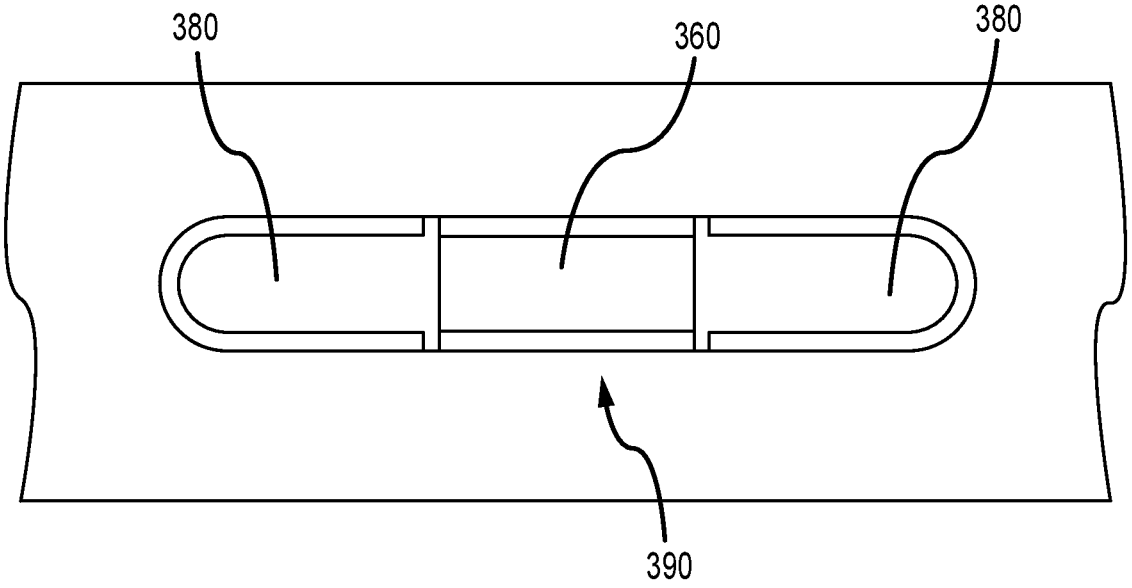
FIG. 14 illustrates a top internal view of the slit and flexure insert of FIG. 12.

FIGS. 12-14 illustrates a third embodiment of a golf club head comprising a slit 330 and a flexure insert 350. The flexure insert 350 comprises an "N-shaped" spring component 360. The N-shaped spring component 360 comprises a front arm 361, a rear arm 363, and a cross arm 365 connecting the front arm 361 and the rear arm 363. The N-shaped spring component 360 is configured to flex within the slit 330 in response to the force of golf ball impact while providing resistance against over flexing of the slit 330. The "N-shaped" spring component 360 could also be viewed as a "Z-shaped" wherein the "Z" is turned on its side.

The front arm 361 comprises a front arm top end 371 and a front arm bottom end 373 opposite the front arm top end 371. The front arm 361 forms a spring front wall 362 extending vertically between the front arm top end 371 and the front arm bottom end 373. The spring front wall 362 forms the forwardmost surface of the flexure insert 350 and is configured to engage the front surface of the slit 330.

Similarly, the rear arm 363 comprises a rear arm top end 375 and a rear arm bottom end 377 opposite the front arm top end 375. The rear arm 363 forms a spring rear wall extending vertically between the rear arm top end 375 and the rear arm bottom end 377. The spring rear wall 363 forms the rearward-most surface of the flexure insert 350 and is configured to engage the rear surface of the slit 330.

The cross arm 365 extends between the front arm 361 and the rear arm 363. In many embodiments, the cross arm 365 extends diagonally from the front arm top end 371 to the rear arm bottom end 377. This orientation forms an "N" shape when viewed in cross-section (as illustrated by FIGS. 12 and 13). In other embodiments (not shown) the cross arm 365 can extend diagonally in the opposite direction, from the front arm bottom end 373 to the rear arm top end 375. The diagonal orientation of the cross arm 365 allows the N-shaped spring component 360 to compress during golf ball impact.

The N-shaped spring component 360 forms a front joint 378 located at the juncture between the cross arm 365 and the front arm 361 and a rear joint 379 located at the juncture between the cross arm 365 and the rear arm 363. The front joint 378 and the rear joint 379 create strategic weak points in the N-shaped spring component 360 that allows the component to compress in a front-to-rear direction. The N-shaped spring component 360 further defines a front joint angle defined as the acute angle formed between the front arm 361 and the cross arm 365. Similarly, the N-shaped spring component 360 defines a rear joint angle defined as the acute angle formed between the rear arm 363 and the cross arm 365. In many embodiments, the front joint angle and the rear joint angle can be substantially similar. In other embodiments, the front joint angle and the rear joint angle can be different. In many embodiments, the front joint angle and/or the rear joint angle can be between approximately 25 degrees and 65 degrees. For example, the front joint angle and/or rear joint angle can be between approximately 25 and 35 degrees, 35 and 45 degrees, 45 and 55 degrees, or 55 and 65 degrees. The front joint angle and the rear joint angle are each measured when the spring component is in a "rest" position wherein the club head is not experiencing any impact forces.

The N-shaped spring component 360 works in conjunction with the cap 380 to form the flexure insert 350. In some embodiments, both the front arm bottom end 373 and the rear arm bottom end 377 can be embedded within the cap 380 such that no portion of the N-shaped spring component 360 is exposed to the exterior of the club head. In some embodiments, the front arm top end 371 and the front arm bottom end 373 may not be embedded within the cap 380, such that the front arm top end 371 and the front arm bottom end 373 are exposed to the hollow interior cavity. In other embodiments, the N-shaped spring component 360 may be entirely embedded within the cap 380 wherein no portion of the N-shaped spring component 360 is exposed to either the exterior of the club head or the hollow interior cavity.

The N-shaped spring component is 360 configured to flex under load of golf ball impact while also providing structural support to the edges and surfaces of the slit 330 to prevent over flexing of the slit 330. Upon impact between the club head and a golf ball, the front joint 378 and the rear joint 379 allow the N-shaped spring component 360 to compress in response to the load applied to the front and rear arms 361, 363 by the edges of the slit 330. The further the N-shaped spring component 360 compresses, the greater resistance the spring component 360 applies to the edges of the slit 330. In this way, the N-shaped spring component 360 allows the slit 330 to flex without over flexing.

The N-shaped spring component 360 is configured to be placed within the central portion 390 of the slit 330 such that the heel and toe portions of the slit 330 lack the spring component 360. The spring component 360 targets and reinforces the central portion 390 of the slit to prevent over bending. In other embodiments, the spring component 360 may be configured to abut the heel or toe portions of the slit 330.

The geometries of the slit 330 as illustrated in the figures are not to be construed as limiting but rather illustrated as an exemplary embodiment. For example, the width, length, profile, and walls of the slit 330 can be adjusted as desired. Furthermore, the geometries of the flexure insert 350 may also be adjusted so that flexure insert 350 is complimentary to the walls of the slit 330.

d. Flexure Insert with Hook Shaped Spring Component

Figure 15:
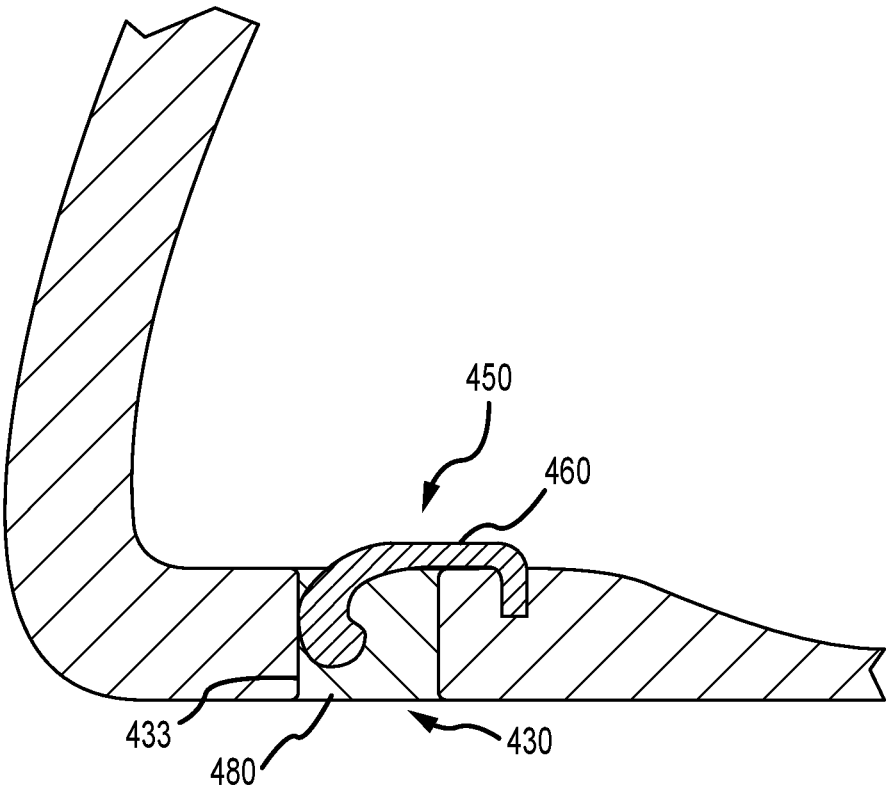
FIG. 15 illustrates a detailed cross-sectional view of the wood-type club head comprising a slit and a flexure insert according to a fourth embodiment.
Figure 16:
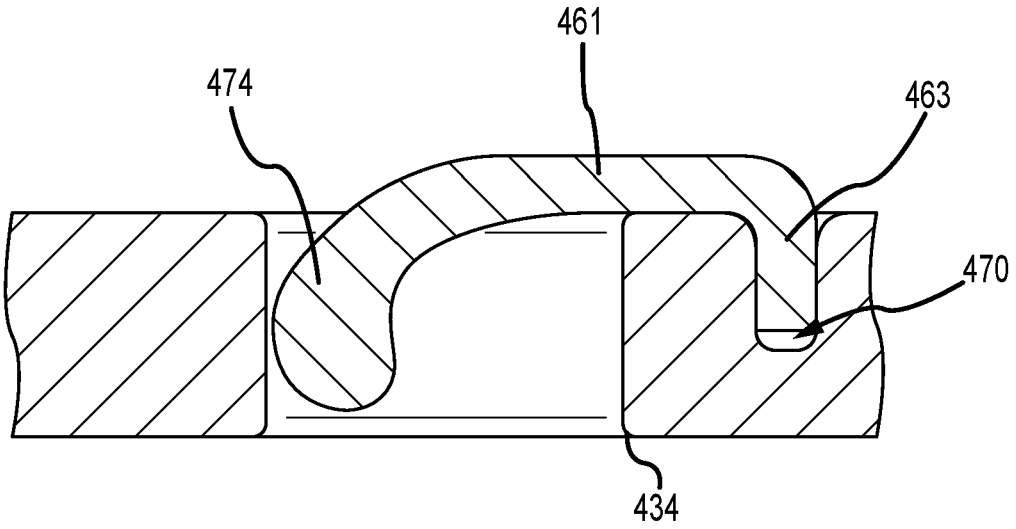
FIG. 16 illustrates a detailed cross sectional view of slit and flexure insert of FIG. 15.
Figure 17:
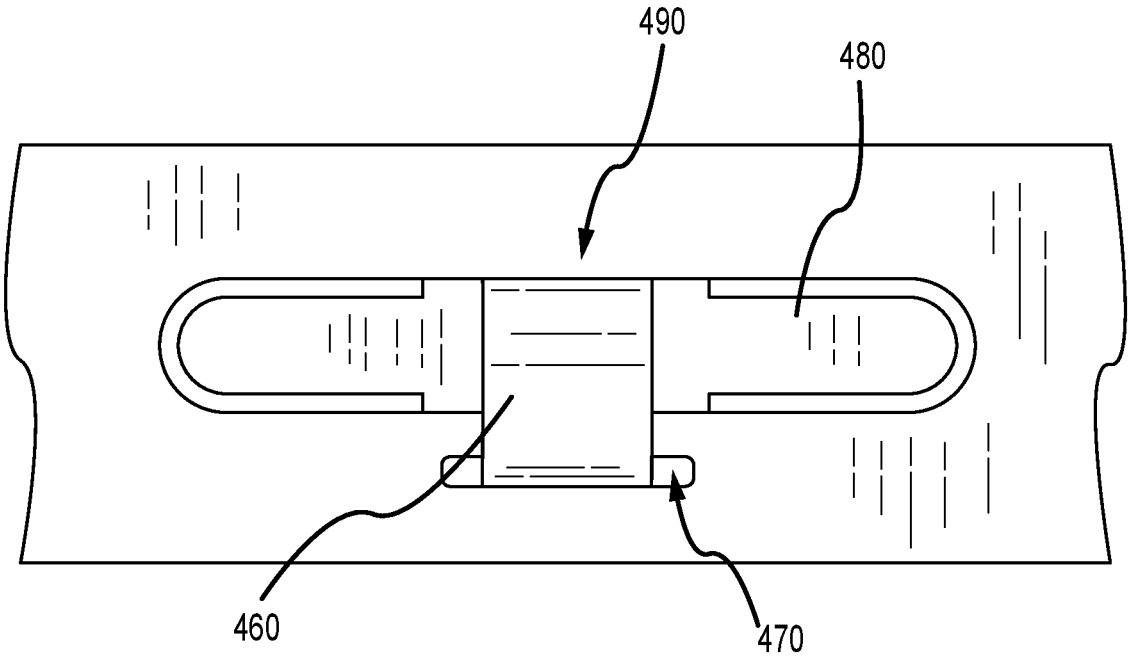
FIG. 17 illustrates a top internal view of the slit and flexure insert of FIG. 15.

FIGS. 15-17 illustrates a fourth embodiment of a club head comprising a slit 430 and a flexure insert 450. In this embodiment, the flexure insert 450 comprises a "hook-shaped" spring component 460. The hook-shaped spring component 460 comprises a bumper 474 configured to engage the front surface 433 of the slit 430 and an anchor 463 spaced rearwardly from the bumper 474 by a shank portion 461. The hook-shaped spring component 460 is configured to flex within the slit 430 in response to the force of golf ball impact while providing resistance against over flexing of the slit 430. The hook-shaped spring component 460 can be non-symmetrical and may comprise a varying thickness.

The bumper 474 is located at a front end of the hook-shaped spring component 460, proximate the front surface 433 of the slit 430. The bumper 474 forms a bumper surface 476 configured to contact the slit front surface 433 as the slit 430 flexes upon impact with a golf ball. The bumper 474 can extend down into the slit 430 from the shank portion 461. In some embodiments, the bumper surface 476 can be substantially flat so as to sit flush against the front surface 433 of the slit 430. In other embodiments, as illustrated by FIGS. 15 and 16, the bumper surface 476 can be curved. In some embodiments, the bumper surface 476 can be configured to contact the front surface 433 of the slit 430 when the club head is in a rest position (wherein the club head is not experiencing any impact forces). In other embodiments, a gap can be formed between the bumper surface 476 and the front surface 433 of the slit 430 when the club head is in a rest position. In embodiments comprising said gap, upon impact with a golf ball, the flexing of the slit 430 closes the gap, and the slit front surface 433 engages the bumper surface 476. Therefore, in such embodiments, the hook-shaped spring component 460 only contacts the front surface 430 of the slit 430 upon impact with a golf ball.

The anchor 463 is located at a rear end of the hook-shaped spring component 460 and attaches within an interior recess 470 of the sole rearward of the slit 430. As illustrated in FIGS. 15-17, the club head comprises a recess 470 in the interior surface of the sole configured to receive the anchor 463. The recess 470 can be spaced rearwardly from the rear edge 434 of the slit 430. The recess 470 can extend approximately parallel to the slit 430 rear edge 434, in a substantially heel-to-toe direction. The anchor 463 can be substantially vertical and extends soleward into the recess 470. Upon impact with a golf ball, the anchor 463 presses against a rear wall of the recess to facilitate compression of the hook-shaped spring component 460.

In many embodiments, the recess 470 can be located corresponding to the heel-to-toe location of the hook-shaped spring component 460 of a particular embodiment. For example, in many embodiments wherein the hook-shaped spring component 460 is located in the central portion of the slit 430, the recess 470 may be located within a central portion 490 of the sole rearward of the central portion 490 of the slit 430.

As mentioned above, the bumper portion 474 and the anchor 463 of the hook-shaped spring component 460 are connected by a shank portion 461. The shank portion 461 can extend substantially in a front-to-rear direction. The shank portion 461 can be partially located within the slit 430 and partially located within the hollow interior cavity. Because the bumper 474 is located within the slit 430 and the anchor 463 is housed within a recess 470 that is spaced rearwardly from the slit 430, the shank portion 461 can extend from the slit 430 to the recess 470 through the interior cavity. In many embodiments, as illustrated in FIG. 15-17, the shank portion 461 bridges a portion of the sole located between the slit rear edge 434 and the recess 470.

The hook-shaped spring component 460 is configured to flex under load of golf ball impact while also providing structural support to the edges and surfaces of the slit 430 to prevent over flexing of the slit 430. The hook-shaped spring component 460 can be compressed in a front-to-back direction upon impact with a golf ball. As the slit 430 flexes, the hook-shaped spring component 460 is compressed between the slit front surface, which applies a rearward force against the bumper 474 and the recess rear wall, forcing the bumper in a downward direction and bending the overall spring component 460, which applies a forward force on the anchor. The further the hook-shaped spring compresses, the greater resistance the spring component applies to the edges of the slit. In this way, the hook-shaped spring allows the slit to flex without over flexing.

The geometries of the slit 430 as illustrated in the figures are not to be construed as limiting but rather illustrated as an exemplary embodiment. For example, the width, length, profile, and walls of the slit 430 can be adjusted as desired. Furthermore, the geometries of the flexure insert 450 may also be adjusted so that flexure insert 450 is complimentary to the walls of the slit 430.

e. Flexure Insert with Elongated U-Shaped Spring Component

Figure 18:
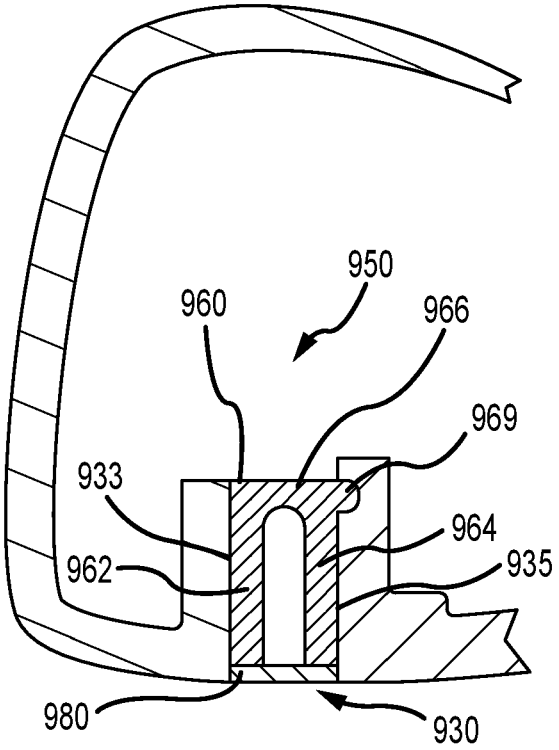
FIG. 18 illustrates a cross-sectional view of the wood-type club head comprising a slit and flexure insert according to a fifth embodiment.

FIG. 18 illustrates another embodiment of a golf club head comprising a slit 930 and flexure insert 950. The flexure insert 950 comprises a cap 980 and a spring component 960. In this embodiment, the spring component 960 is configured to abut the front surface 933 and rear surface 935 of the slit 930. The front surface 933 and rear surface 935 of the slit 930 extend inwardly into the interior of the club head to provide sufficient surface area for to the flexure insert 950 to adhere to. The rear surface 935 of the slit comprises an indentation 937 which aids in securing the spring component 960 to the slit 930. The indentation 937 is located on the top end of the rear surface 935.

The spring component 960 comprises a front wall 962, a rear wall 964, and a top wall 966 to create an elongated U-shaped appearance. The rear wall 964 comprises a protrusion 969 which extends rearwardly away from the rear wall 964 at the top portion of the rear wall 964. The protrusion 969 is configured to be received by the recess 937 of the rear surface 935 of the slit 930.

Upon impact with a golf ball, the front surface 933 of the slit 930 translates forward thereby compressing the spring component 960. The front wall 962 of the insert will also translate forwards, decreasing the distance between the front wall 962 and rear wall 964. The front wall 962 and rear wall 964 bend around the top wall 966.

The geometries of the slit 930 as illustrated in the figures are not to be construed as limiting but rather illustrated as an exemplary embodiment. For example, the width, length, profile, and walls of the slit 930 can be adjusted as desired. Furthermore, the geometries of the flexure insert 950 may also be adjusted so that flexure insert 950 is complimentary to the walls of the slit 930.

f. Flexure Embodiment with Cross Arm

Figure 19:
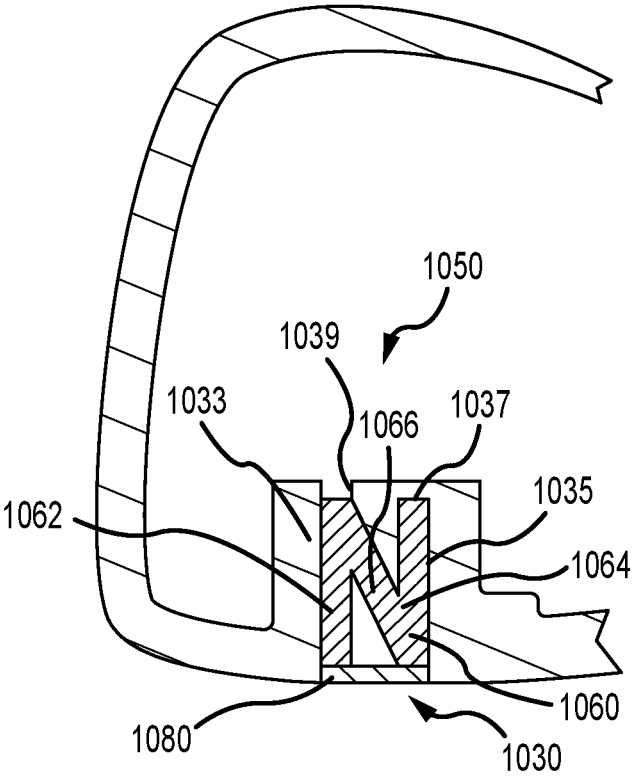
FIG. 19 illustrates a cross-sectional view of the wood-type club head comprising a slit and flexure insert according to a sixth embodiment.

FIG. 19 illustrates another embodiment of a golf club head comprising a slit 1030 and flexure insert 1050. The flexure insert 1050 comprises a cap 1080 and a spring component 1060. In this embodiment, the slit 1030 comprises a front surface 1033, a rear surface 1035, and an upper surface. The spring component 1060 can be configured to abut the front surface 1033, the rear surface 1035, and the upper surface of the slit 1030. The front surface 1033 and rear surface 1035 of the slit 1030 extend inwardly into the interior of the club head to provide sufficient surface area for to the flexure insert 1050 to adhere to. The upper surface 1037 extends from the rear surface 1035, in a direction toward the front surface 1033. The upper surface 1037 comprises a protrusion 1039, extending in a direction away from the interior of the club head, which aids in securing the spring component 1060 to the slit 1030.

The spring component 1060 can comprise geometry that is similar in many ways to the "N" shaped spring component 360, described previously. The spring component 1060 comprises a front arm 1062, a rear arm 1064, and a cross arm 1066 connecting the front arm 1061 and the rear arm 1063. The spring component 1060 is configured to flex within the slit 1030 in response to the force of golf ball impact while providing resistance against over flexing of the slit 1030. The front arm 1061, rear arm 1063, and cross arm 1065 are configured to connect and function similarly to those of the front arm 361, rear arm 363, and cross arm 365 of the "N" shaped spring component 360. The upper surface protrusion 1039 can abut both the cross arm 1065 and the rear arm 1063 of the spring component 1060. As illustrated in FIG. 19, the protrusion 1039 can comprise a shape that corresponds to the geometry of the cross arm 1065 and rear arm 1063. The upper surface 1037 of the slit 1030 can abut an end of the rear arm 1063 and be positioned further into the interior of the club head than the spring component 1060.

Upon impact with a golf ball, the front surface 1033 of the slit 1030 translates forward thereby compressing the spring component 1060. The front arm 1062 also translated rearward, decreasing the distance between the front arm 1062 and the cross arm 1066.

The geometries of the slit 1030 as illustrated in the figures are not to be construed as limiting but rather illustrated as an exemplary embodiment. For example, the width, length, profile, and walls of the slit 1030 can be adjusted as desired. Furthermore, the geometries of the flexure insert 1050 may also be adjusted so that flexure insert 1050 is complimentary to the walls of the slit 1030.

g. Flexure Insert with Spring Component Comprising Concave Converging Walls

Figure 20:
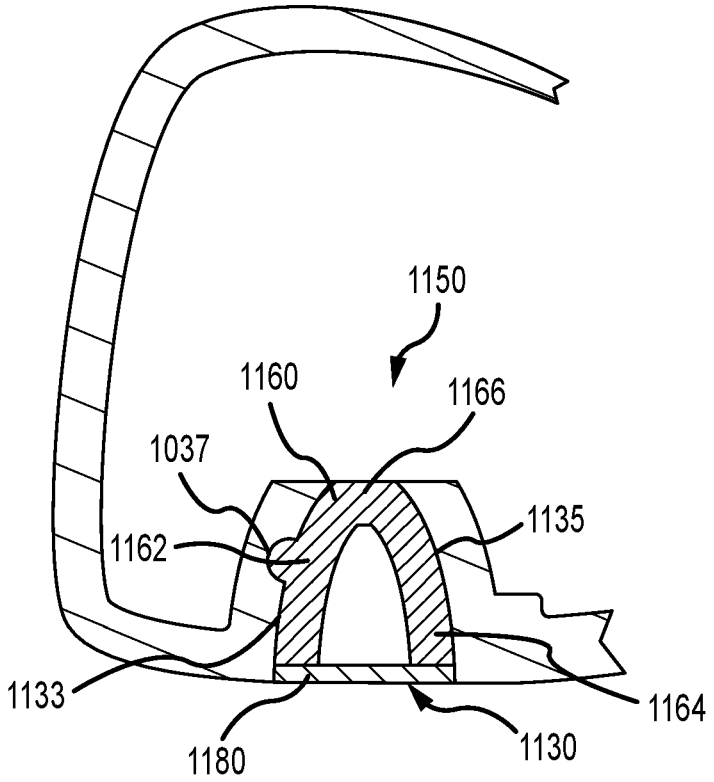
FIG. 20 illustrates a cross-sectional view of the wood-type club head comprising a slit and flexure insert according to a seventh embodiment.

FIG. 20 illustrates another embodiment of a golf club head comprising a slit 1130 and flexure insert 1100. The flexure insert 1100 comprises a cap 1180 and a spring component 1160. In this embodiment, the slit 1130 comprises a front surface 1133, a rear surface 1135, and a recess 1137 in the front surface 1133. The recess 1137 aids in positioning and securing the insert to the slit 1130. The spring component 1160 can be configured to abut the front surface 1133 and the rear surface 1135. The front surface 1133 and rear surface 1135 of the slit 1130 extend inwardly into the interior of the club head to provide sufficient surface area for to the flexure insert 1100 to adhere to. Furthermore, the front surface 1133 and the rear surface 1135 extend inwardly into the interior of the club head in a curved manner such that the top ends of the front surface 1133 and rear surface 1135 are closer together than the bottom ends. In other words, the front surface 1133 and rear surface 1135 of the slit 1130 are concave. In other embodiments, the front surface 1133 and/or rear surface 1133 can comprise a convex curvature or no curvature.

The spring component 1160 can comprise geometry that is similar in many ways to the "U" shaped spring component 160, described previously. The spring component 1160 comprises a front wall 1162, a rear wall 1164, and a top wall 1166 connecting the front wall 1162 and the rear wall 1164. The spring component 1160 is configured to flex within the slit 1130 in response to the force of golf ball impact while providing resistance against over flexing of the slit 1130. The front wall 1162, rear wall 1164, and cross wall 1166 are configured to connect and function similarly to those of the front wall 162, rear wall 164, and top wall 166 of the "U" shaped spring component 160. The front wall 1162 of the spring component 1160 comprises a protrusion 1169 configured to be received by the recess 1137.

Upon impact with a golf ball, the front surface 1133 of the slit 1130 translates forward thereby compressing the spring component 1160. The front wall 1162 of the insert will also translate forwards, decreasing the distance between the front wall 1162 and rear wall 11964. The front wall 1162 and rear wall 1164 bend around the top wall 1166.

The geometries of the slit 1130 as illustrated in the figures are not to be construed as limiting but rather illustrated as an exemplary embodiment. For example, the width, length, profile, and walls of the slit 1130 can be adjusted as desired. Furthermore, the geometries of the flexure insert 1150 may also be adjusted so that flexure insert 1150 is complimentary to the walls of the slit 1130.

h. Flexure Insert with V-Shaped Spring Component

Figure 21:
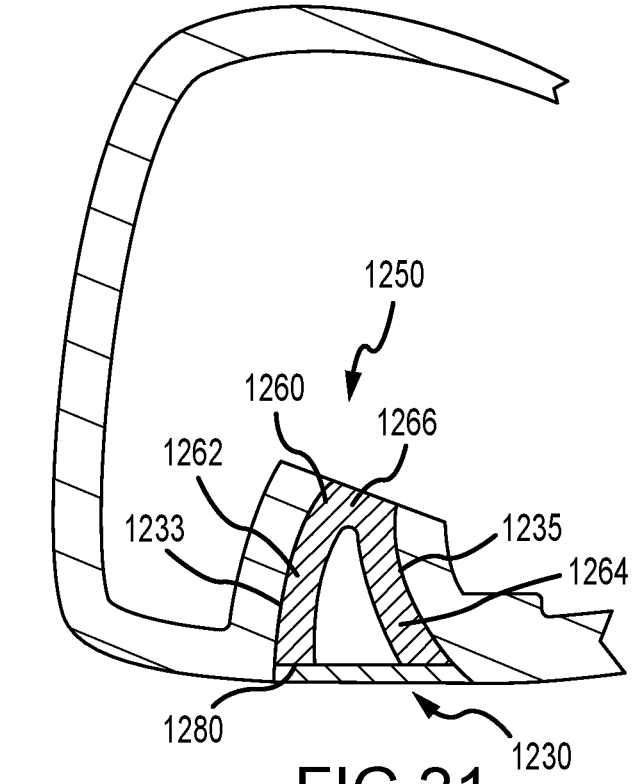
FIG. 21 illustrates a cross-sectional view of the wood-type club head comprising a slit and flexure insert according to an eighth embodiment.

FIG. 21 illustrates another embodiment of a golf club head comprising a slit 1230 and flexure insert 1250. The flexure insert 1250 comprises a cap 1280 and a spring component 1260. In this embodiment, the slit 1230 comprises a front surface 1233 and a rear surface 1235. The spring component 1260 can be configured to abut the front surface 1233 and the rear surface 1235. The front surface 1233 and rear surface 1235 of the slit 1230 extend inwardly into the interior of the club head to provide sufficient surface area for to the flexure insert 1250 to adhere to. Furthermore, the front surface 1233 and the rear surface 1235 extend inwardly into the interior of the club head in a curved manner. The front surface 1233 comprises a concave shape while the rear surface 1235 comprises a convex shape.

The "V" shaped spring component 1160 can comprise geometry that is similar in many ways to the "U" shaped spring component 160, described previously. The spring component 1260 comprises a front wall 1261, a rear wall 1263, and a top wall 1265 connecting the front wall 1261 and the rear wall 1263. The spring component 1260 is configured to flex within the slit 1230 in response to the force of golf ball impact while providing resistance against over flexing of the slit 1230. The front wall 1262, rear wall 1264, and cross wall 1266 are configured to connect and function similarly to those of the front wall 162, rear wall 164, and top wall 166 of the "U" shaped spring component 160.

Upon impact with a golf ball, the front surface 1233 of the slit 1230 translates forward thereby compressing the spring component 1260. The front wall 1262 of the insert will also translate forwards, decreasing the distance between the front wall 1262 and rear wall 1264. The front wall 1262 and rear wall 1264 bend around the top wall 1266.

The geometries of the slit 1230 as illustrated in the figures are not to be construed as limiting but rather illustrated as an exemplary embodiment. For example, the width, length, profile, and walls of the slit 1230 can be adjusted as desired. Furthermore, the geometries of the flexure insert 1250 may also be adjusted so that flexure insert 1250 is complimentary to the walls of the slit 1230.

i. Flexure Insert Comprising U-Shaped Spring Component with Curved Rear Wall

Figure 22:
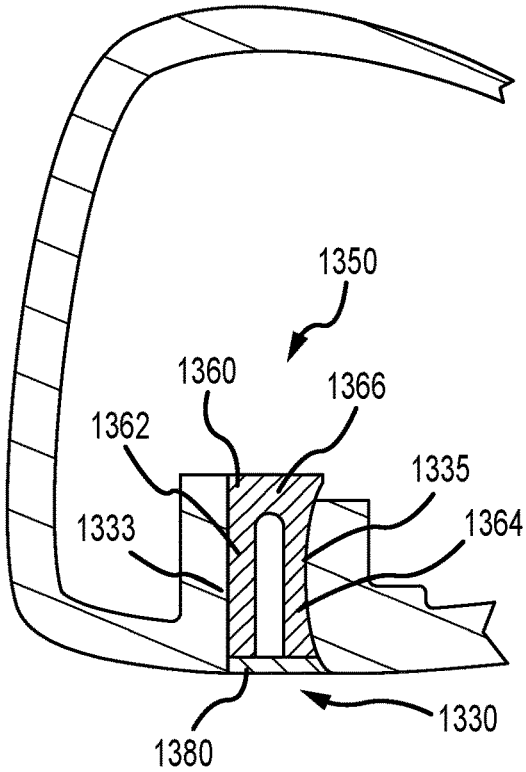
FIG. 22 illustrates a cross-sectional view of the wood-type club head comprising a slit and flexure insert according to a ninth embodiment.

FIG. 22 illustrates another embodiment of a golf club head comprising a slit 1330 and flexure insert 1350. The flexure insert 1350 comprises a cap 1380 and a spring component 1360. In this embodiment, the slit 1330 comprises a front surface 1333 and a rear surface 1335. The spring component 1360 can be configured to abut the front surface 1333 and the rear surface 1335. The front surface 1333 and rear surface 1335 of the slit 1330 extend inwardly into the interior of the club head to provide sufficient surface area for to the flexure insert 1350 to adhere to. Furthermore, the front surface 1333 comprises an approximately flat surface while the rear surface 1335 comprises a curved surface. The rear surface 1335 is concave. The curvature of the rear surface 1335 helps secure in the insert 1350 in place.

The spring component 1360 can comprise geometry that is similar in many ways to the "U" shaped spring component 160, described previously. The spring component 1360 comprises a front wall 1360, a rear wall 1362, and a top wall 1366 connecting the front wall 1362 and the rear wall 1364. The spring component 1360 is configured to flex within the slit 1330 in response to the force of golf ball impact while providing resistance against over flexing of the slit 1330. The front wall 1362, rear wall 1364, and top wall 1366 are configured to connect and function similarly to those of the front wall 162, rear wall 164, and top wall 166 of the "U" shaped spring component 160. The rear wall 1364 comprises complimentary geometry to the curved rear surface 1335 of the slit 1330.

Upon impact with a golf ball, the front surface 1333 of the slit 1330 translates forward thereby compressing the spring component 1360. The front wall 1362 of the insert will also translate forwards, decreasing the distance between the front wall 1362 and rear wall 1364. The front wall 1362 and rear wall 1364 bend around the top wall 1366.

The geometries of the slit 1330 as illustrated in the figures are not to be construed as limiting but rather illustrated as an exemplary embodiment. For example, the width, length, profile, and walls of the slit 1330 can be adjusted as desired. Furthermore, the geometries of the flexure insert 1350 may also be adjusted so that flexure insert 1350 is complimentary to the walls of the slit 1330.

j. Flexure Insert with U-Shaped Spring Component and Curved Surface

Figure 23:
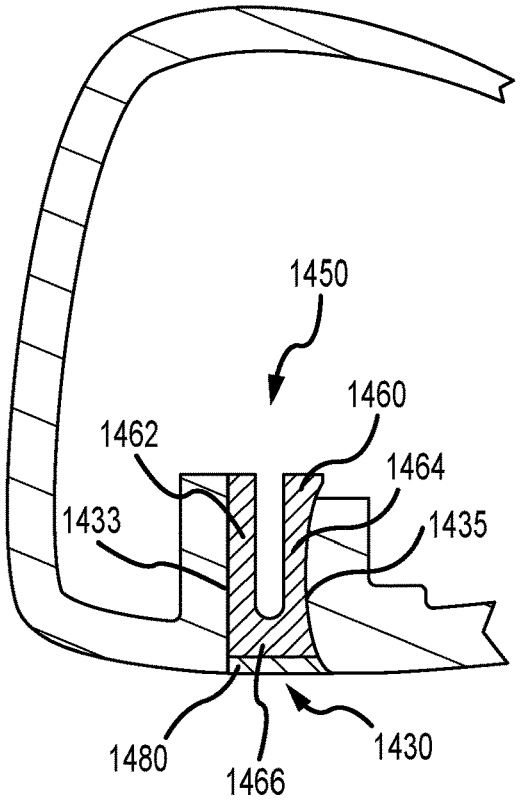
FIG. 23 illustrates a cross-sectional view of the wood-type club head comprising a slit and flexure insert according to a tenth embodiment.

FIG. 23 illustrates another embodiment of a golf club head comprising a slit 1430 and flexure insert 1450. The flexure insert 1450 comprises a cap 1480 and a spring component 1460. In this embodiment, the slit 1430 comprises a front surface 1433 and a rear surface 1435. The spring component 1460 can be configured to abut the front surface 1433 and the rear surface 1435. The front surface 1433 and rear surface 1435 of the slit 1430 extend inwardly into the interior of the club head to provide sufficient surface area for to the flexure insert 1450 to adhere to. Furthermore, the front surface 1433 comprises an approximately flat surface while the rear surface 1435 comprises a curved surface. The rear surface 1435 is concave. The curvature of the rear surface 1435 helps secure in the insert 1450 in place.

The spring component 1460 can comprise geometry that is similar in many ways to the "U" shaped spring component 160, described previously. The spring component 1460 comprises a front wall 1460, a rear wall 1462, and a bottom wall 1466 connecting the front wall 1462 and the rear wall 1464. The spring component 1460 is configured to flex within the slit 1430 in response to the force of golf ball impact while providing resistance against over flexing of the slit 1430. The front wall 1462, rear wall 1464, and bottom wall 1466 are configured to connect and function similarly to those of the front wall 162, rear wall 164, and top wall 166 of the "U" shaped spring component 160. The rear wall 1464 comprises complimentary geometry to the curved rear surface 1435 of the slit 1430.

Upon impact with a golf ball, the front surface 1433 of the slit 1430 translates forward thereby compressing the spring component 1460. The front wall 1462 of the insert will also translate forwards, decreasing the distance between the front wall 1462 and rear wall 1464. The front wall 1462 and rear wall 164 bend around the bottom wall 1466.

The geometries of the slit 1430 as illustrated in the figures are not to be construed as limiting but rather illustrated as an exemplary embodiment. For example, the width, length, profile, and walls of the slit 1430 can be adjusted as desired. Furthermore, the geometries of the flexure insert 1450 may also be adjusted so that flexure insert 1450 is complimentary to the walls of the slit 1430.

k. Flexure Insert with Two Cross Arms

Figure 24:
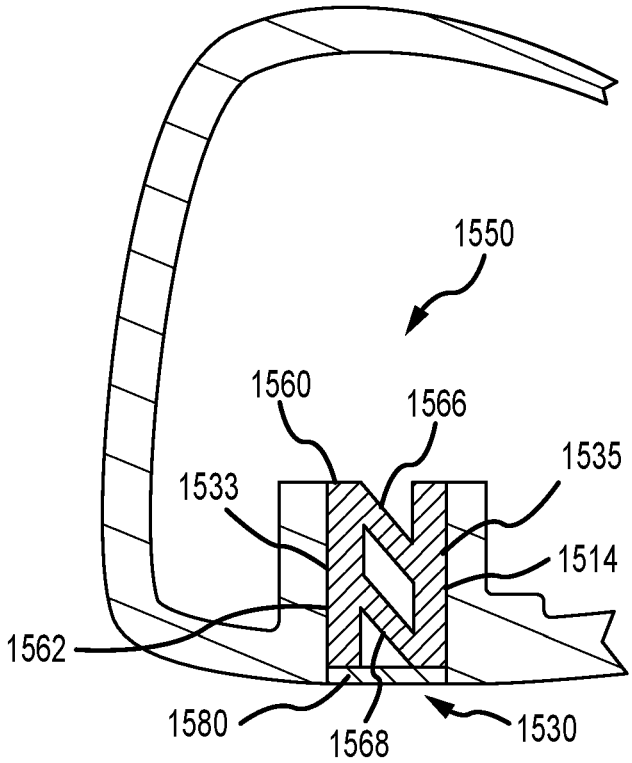
FIG. 24 illustrates a cross-sectional view of the wood-type club head comprising a slit and flexure insert according to an eleventh embodiment.

FIG. 24 illustrates another embodiment of a golf club head comprising a slit 1530 and flexure insert 1550. The flexure insert 1550 comprises a cap 1580 and a spring component 1560. The spring component 1560 can be configured to abut the front surface 1533 and the rear surface 1535. The front surface 1533 and rear surface 1535 of the slit 1530 extend inwardly into the interior of the club head to provide sufficient surface area for to the flexure insert 1550 to adhere to. Furthermore, the front surface 1533 and the rear surface 1535 extend inwardly into the interior cavity of the club head in a generally vertical manner such that the top ends of the front surface 1533 and rear surface 1535 are approximately equal distance than the bottom ends of the front surface 1533 and the rear surface 1535.

The spring component 1560 can comprise geometry that is similar in many ways to the "N" shaped spring component 360, described previously. The spring component 1560 comprises a front arm 1562, a rear arm 1564, a first cross arm 1566 connecting the front arm 1562 and the rear arm 1564, and a second cross arm 1568 connecting the front arm 1562 and the rear arm 1564. The first cross arm 1566 can be more proximate the interior cavity of the club head. The second cross arm 1568 can be more proximate the sole of the golf club. The first cross arm 1566 and the second cross arm 1568 can be spaced a distance from each other. The spring component 1560 is configured to flex within the slit 1530 in response to the force of golf ball impact while providing resistance against over flexing of the slit 1530. The front arm 1562, rear arm 1564, and cross arm 1566 are configured to connect and function similarly to those of the front arm 361, rear arm 363, and cross arm 365 of the "N" shaped spring component 360. The upper surface protrusion 1539 can abut both the cross arm 1566 and the rear arm 1564 of the spring component 1560. As illustrated in FIG. 19, the protrusion 1539 can comprise a shape that corresponds to the geometry of the cross arm 1566 and rear arm 1564. The upper surface 1537 of the slit 1530 can abut an end of the rear arm 1564 and be positioned further into the interior of the club head than the spring component 1560.

Upon impact with a golf ball, the front surface 1533 of the slit 1530 translates forward thereby compressing the spring component 1560. The front arm 1562 of the insert will also translate forwards, decreasing the distance between the front arm 1562 and rear arm 1564. The orientation and angle of the first cross arm 1566 and second cross arm 1568 will cause the front arm 1562 to also move slightly inward toward the interior of the club head when the spring component 1560 is compressed.

The geometries of the slit 1530 as illustrated in the figures are not to be construed as limiting but rather illustrated as an exemplary embodiment. For example, the width, length, profile, and walls of the slit 1530 can be adjusted as desired. Furthermore, the geometries of the flexure insert 1550 may also be adjusted so that flexure insert 1550 is complimentary to the walls of the slit 1530.

l. Flexure Insert with Z-Shaped Spring Component

Figure 25:
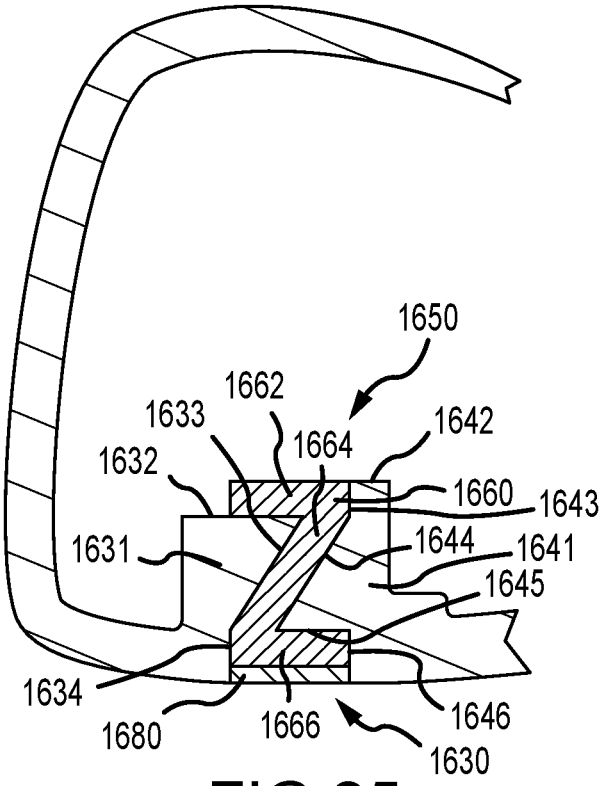
FIG. 25 illustrates a cross-sectional view of the wood-type club head comprising a slit and flexure insert according to a twelfth embodiment.

FIG. 25 illustrates another embodiment of a golf club head comprising a slit 1630 and flexure insert 1650. The flexure insert 1650 comprises a cap 1680 and a spring component 1660. In this embodiment, the slit 1630 comprises a front wall 1631 and a rear wall 1641. The front wall 1631 comprises a top surface 1632, an angled surface 1633, and a bottom surface 1635. The rear wall 1641 comprises a top horizontal surface 1642, a top vertical surface 1643, an angled surface 1644, a bottom horizontal surface 1645, and a bottom vertical surface 1646. The surfaces of the front wall 1631 and rear wall 1641 extend inwardly into the interior cavity of the club head to provide sufficient surface for the flexure insert 1650 to adhere to. In other embodiments, the front wall 1631 and rear wall 1641 can comprise other combination of surfaces and geometries to improve manufacturability and durability of the slit 1630.

The spring component 1660 can comprise a "Z-shaped" configuration, wherein the spring component 1660 comprises a top arm 1662, a cross arm 1664, and a bottom arm 1666. The spring component 1660 comprises complimentary geometry to the surface of the front wall 1631 and rear wall 1641 of the slit 1630. The "Z-shaped" configuration improves the inserts 1650 ability to be held within the slit 1630.

The geometries of the slit 1630 as illustrated in the figures are not to be construed as limiting but rather illustrated as an exemplary embodiment. For example, the width, length, profile, and walls of the slit 1630 can be adjusted as desired. Furthermore, the geometries of the flexure insert 1650 may also be adjusted so that flexure insert 1650 is complimentary to the walls of the slit 1630.

m. Flexure Insert with Upside-Down U-Shaped Spring Component and Protrusions

Figure 26:
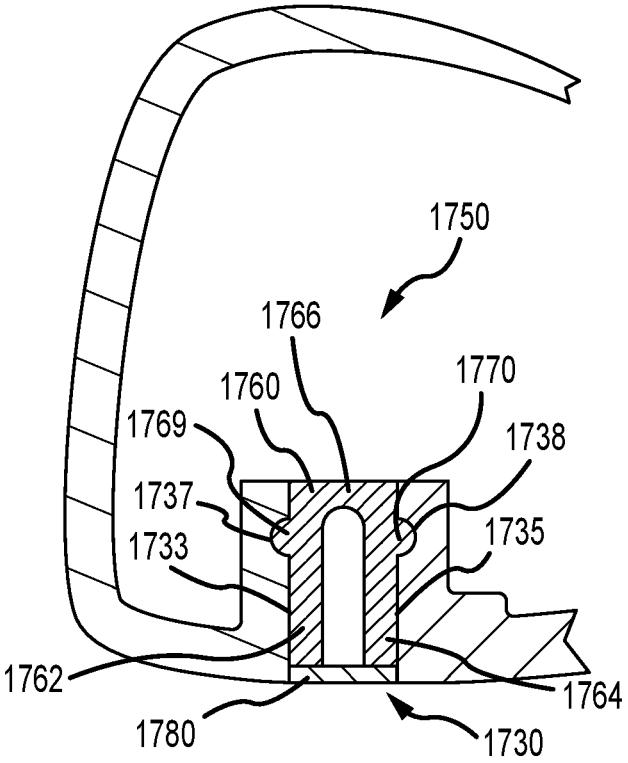
FIG. 26 illustrates a cross-sectional view of the wood-type club head comprising a slit and flexure insert according to a thirteenth embodiment.

FIG. 26 illustrates another embodiment of a golf club head comprising a slit 1730 and flexure insert 1750. The flexure insert 1750 comprises a cap 1780 and a spring component 1760. In this embodiment, the slit 1730 comprises a front surface 1733, a rear surface 1735, a first recess 1737 in the front surface 1733 and a second recess 1738 on the rear surface 1735. The first recess 1737 and the second recess 1738 aid in positioning and securing the flexure insert 1750 to the slit 1730. The spring component 1760 can be configured to abut the front surface 1733 and the rear surface 1735. The front surface 1733 and rear surface 1735 of the slit 1730 extend inwardly into the interior cavity of the club head to provide sufficient surface area for to the flexure insert 1750 to adhere to. Furthermore, the front surface 1733 and the rear surface 1735 extend inwardly into the interior cavity of the club head in a generally vertical manner such that the top ends of the front surface 1733 and rear surface 1735 are approximately equal distance than the bottom ends of the front surface 1733 and the rear surface 1735.

The spring component 1760 can comprise geometry that is similar in many ways to the "U" shaped spring component 160, described previously. The spring component 1760 comprises a front wall 1762, a rear wall 1764, and a top wall 1766 connecting the front wall 1762 and the rear wall 1764. The spring component 1760 is configured to flex within the slit 1730 in response to the force of golf ball impact while providing resistance against over flexing of the slit 1730. The front wall 1762, rear wall 1764, and a top wall 1766 are configured to connect and function similarly to those of the front wall 162, rear wall 164, and top wall 166 of the "U" shaped spring component 160. In the present embodiment the top wall 1766 is locate proximate the interior cavity of the golf club head. The front wall 1762 of the spring component 1760 comprises a first protrusion 1769 and a second protrusion 1770 configured to be received by the first recess 1737 and the second recess 1738.

Upon impact with a golf ball, the front surface 1733 of the slit 1730 translates forward thereby compressing the spring component 1760. The front wall 1762 of the insert will also translate forwards, decreasing the distance between the front wall 1762 and rear wall 1764. The front wall 1762 and rear wall 1764 bend around the top wall 1766.

The geometries of the slit 1730 as illustrated in the figures are not to be construed as limiting but rather illustrated as an exemplary embodiment. For example, the width, length, profile, and walls of the slit 1730 can be adjusted as desired. Furthermore, the geometries of the flexure insert 1750 may also be adjusted so that flexure insert 1750 is complimentary to the walls of the slit 1730.

n. Flexure Elongated U-Shaped Spring Component with Protrusions

Figure 27:
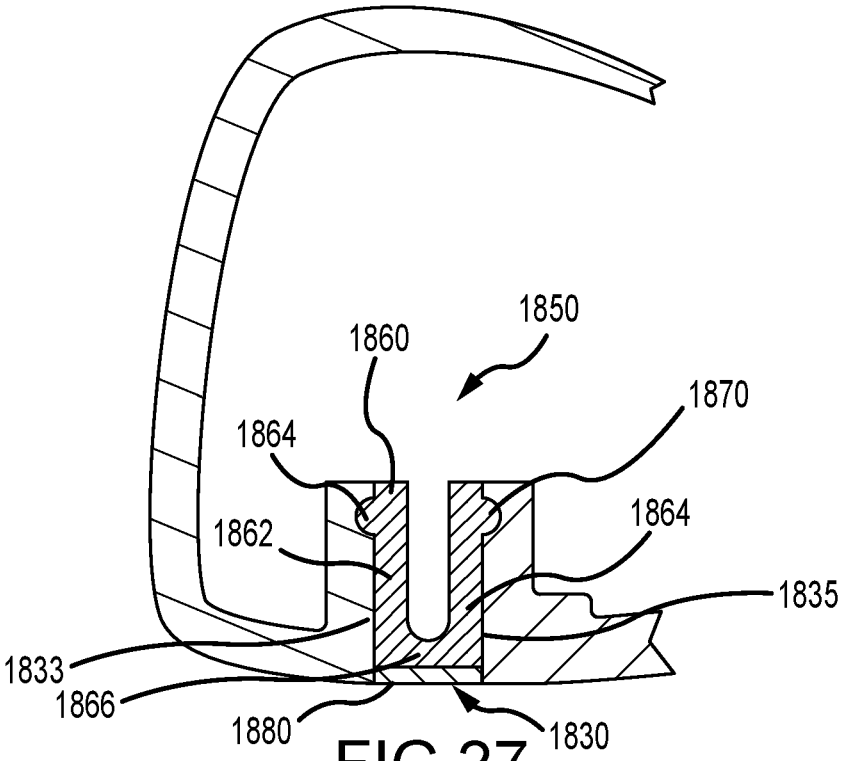
FIG. 27 illustrates a cross-sectional view of the wood-type club head comprising a slit and flexure insert according to a fourteenth embodiment.

FIG. 27 illustrates another embodiment of a golf club head comprising a slit 1830 and flexure insert 1850. The flexure insert 1850 comprises a cap 1880 and a spring component 1860. In this embodiment, the slit 1830 comprises a front surface 1833, a rear surface 1835, and a recess 1837 in the front surface 1833. The recess 1837 aids in positioning and securing the insert to the slit 1830. The spring component 1860 can be configured to abut the front surface 1833 and the rear surface 1835. The front surface 1833 and rear surface 1835 of the slit 1830 extend inwardly into the interior of the club head to provide sufficient surface area for to the flexure insert 1850 to adhere to. Furthermore, the front surface 1833 and the rear surface 1835 extend inwardly into the interior cavity of the club head in a generally vertical manner such that the top ends of the front surface 1833 and rear surface 1835 are approximately equal distance than the bottom ends of the front surface 1833 and the rear surface 1835.

The spring component 1860 can comprise geometry that is similar in many ways to the "U" shaped spring component 160, described previously. The spring component 1860 comprises a front wall 1862, a rear wall 1864, and a bottom wall 1866 connecting the front wall 1862 and the rear wall 1864. The spring component 1860 is configured to flex within the slit 1830 in response to the force of golf ball impact while providing resistance against over flexing of the slit 1830. The front wall 1862, rear wall 1864, and bottom wall 1866 are configured to connect and function similarly to those of the front wall 162, rear wall 164, and top wall 166 of the "U" shaped spring component 160. In the present embodiment the bottom wall 1866 is locate proximate the sole of the golf club head. The front wall 1862 of the spring component 1860 comprises a first protrusion 1869 and a second protrusion 1870 configured to be received by the first recess 1837 and the second recess 1838.

Upon impact with a golf ball, the front surface 1833 of the slit 1830 translates forward thereby compressing the spring component 1860. The front wall 1862 of the insert will also translate forwards, decreasing the distance between the front wall 1862 and rear wall 1864. The front wall 1862 and rear wall 1864 bend around the bottom wall 1866.

The geometries of the slit 1830 as illustrated in the figures are not to be construed as limiting but rather illustrated as an exemplary embodiment. For example, the width, length, profile, and walls of the slit 1830 can be adjusted as desired. Furthermore, the geometries of the flexure insert 1850 may also be adjusted so that flexure insert 1850 is complimentary to the walls of the slit 1830.

V. Slit Retaining Wall Structure

The performance of the slit 130 (i.e. the amount of strike face 102 flexure the slit creates) can depend on the structure of the slit 130. The slit 130 structure refers to the structure surrounding the through-opening created by the slit 130 and can include various walls of the slit 130 and features of the club head 100 that are adjacent to the slit 130. The structure of the slit 130 can influence how the slit 130 bends as well as how the flexure insert 150 is retained within the slit 130. In some cases, the slit 130 structure can further influence the durability of the slit 130 and can help in preventing failure of the sole 112. In many embodiments, it can be desirable to provide a minimal complexity to the slit 130 structure to allow for a simplified manufacture. In many embodiments, structure of the slit 130 can include features such a mass pads (described in further detail below) that can alter the mass properties of the club head 100 to compensate for the addition of the slit 130.

As described above, in many embodiments, the slit 130 can be a basic opening through the sole 112. In such embodiments, the slit 130 structure is not formed by any retaining walls or built-up structure around the slit 130, the walls and surfaces of the slit 130 are simply formed by the thickness of the sole 112. In many such embodiments, the thickness of the sole 112 at the forward edge 132 of the slit 130 can be similar or equal to the thickness of the sole 112 at the rearward edge 134 of the slit 130.

In many embodiments, rather than a forming a basic slit 130, the club head 100 can comprise a slit 130 with a structure containing one or more retaining walls or other built-up features surrounding the slit 130. As described above, the slit 130 structure can improve the durability and flexibility properties of the slit 130 as well as the ability of the slit 130 to retain a flexure insert 150.

Figure 29:
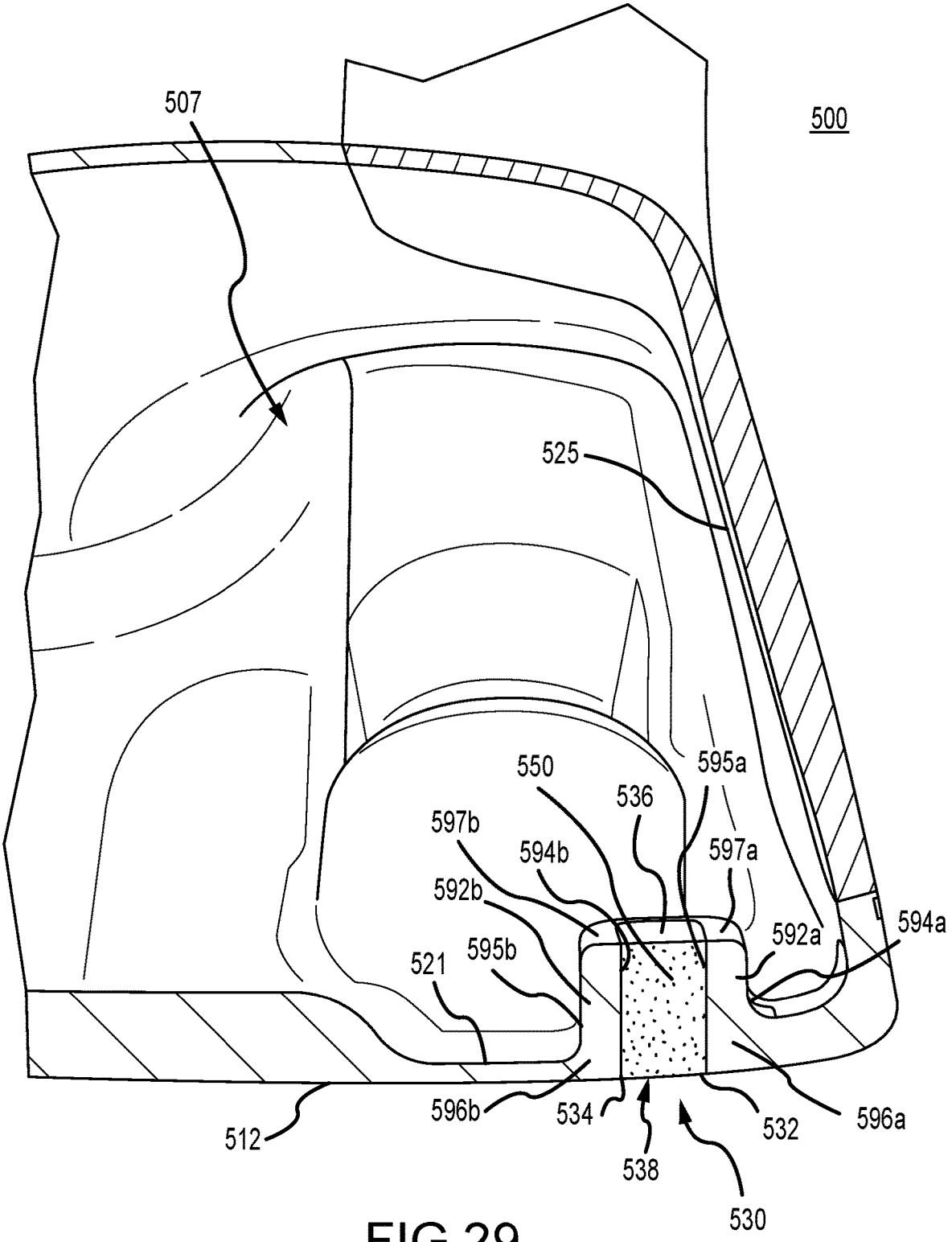
FIG. 29 illustrates a cross-sectional view of the golf club head of FIG. 28 comprising a slit formed by a plurality of retaining walls according to a first embodiment.

FIG. 29 illustrates a club head 500 comprising a slit 530 bounded by a plurality of retaining walls 592. The retaining walls 592 are formed by the sole 112 and form the edges 532, 534 of the slit 530. The retaining walls 592 can be features of the sole 512 that extend upwards from the interior surface 521 of the sole 512 into the interior cavity 507. The retaining walls 592 are configured to hold the flexure insert 550 in place such that the flexure insert 550 abuts the retaining walls 592 and fills the slit 530. The plurality of retaining walls 592 comprise a front retaining wall 592*a* located at the forward edge 532 of the slit 530 and a rear retaining wall 592*b* located at the rear edge 534 of the slit 530.

In the embodiment of FIG. 29, The front retaining wall 592*a* can be a vertical wall such that the front wall 592*a* can extend substantially perpendicular to the interior surface 521 of the sole 512. The front retaining wall 592*a* further comprises a front surface 594*a* disposed toward the back face 525 and a rear surface 594*b* disposed toward the slit 530 and configured to abut the flexure insert 550. The front retaining wall 592*a* comprises a base 596*a* at the junction between the front retaining wall 592*a* and the sole 512 and a free top end 597*a* opposite the base 596*a*.

Similarly, the rear retaining wall 592*b* can be a vertical wall extending substantially perpendicular to the interior surface 521 of the sole 512. The rear retaining wall 592*b* further comprises a front surface 594*a* disposed toward the slit 530 and configured to abut the flexure insert 550 and a rear surface 595*b* disposed toward the rear 511 of the club head 500. Similar to the front retaining wall 592*a*, the rear retaining wall 592*b* comprises a base 596*b* at the junction between the rear retaining wall 592*b* and the sole 512 and a free top end 597*b* opposite the base 596*b*. In many embodiments, the front retaining wall 592*a* and the rear retaining wall 592*b* can be substantially parallel to one another. In other embodiments, one or both retaining walls 592 can be angled with respect to the other.

Being located on the forward edge 532 and the rearward edge 534, respectively, of the slit 530, the front retaining wall 592*a* and the rear retaining wall 592*b* are spaced apart from one another in a front-to-rear direction and form a through-opening from the exterior of the club head 500 into the interior cavity 507. The slit 530 forms an exterior opening 538 between the front retaining wall base 596*a* and the rear retaining wall base 596*b*. The exterior opening 538 forms the entrance into the slit 530 from the exterior of the club head 500. The slit 530 further forms an interior opening 536 between the front retaining wall top end 597*a* and the rear retaining wall top end 597*b*. The interior opening 536 forms the exit of the slit 530 into the interior cavity 507.

The retaining walls 592 illustrated in FIG. 29 can serve multiple benefits. The surfaces to which the flexure insert 550 abuts (i.e. the rear surface 595*a* of the front retaining wall 592*a* and the front surface 594*b* of the rear retaining wall 592*b*) provide an increased surface area for the flexure insert 550 to adhere or couple to. Said increased surface area can increase the ability of the slit 530 to retain the flexure insert 550. Further, the retaining walls 592 provide extra mass around the edges 532, 534 of the slit 530, reinforcing the slit 530 and increasing durability. The vertical retaining walls 592 illustrated in FIG. 29 comprise a simple geometry that is not difficult to cast. Therefore, providing the retaining walls 592 does not complicate the manufacturing process.

Figure 30:
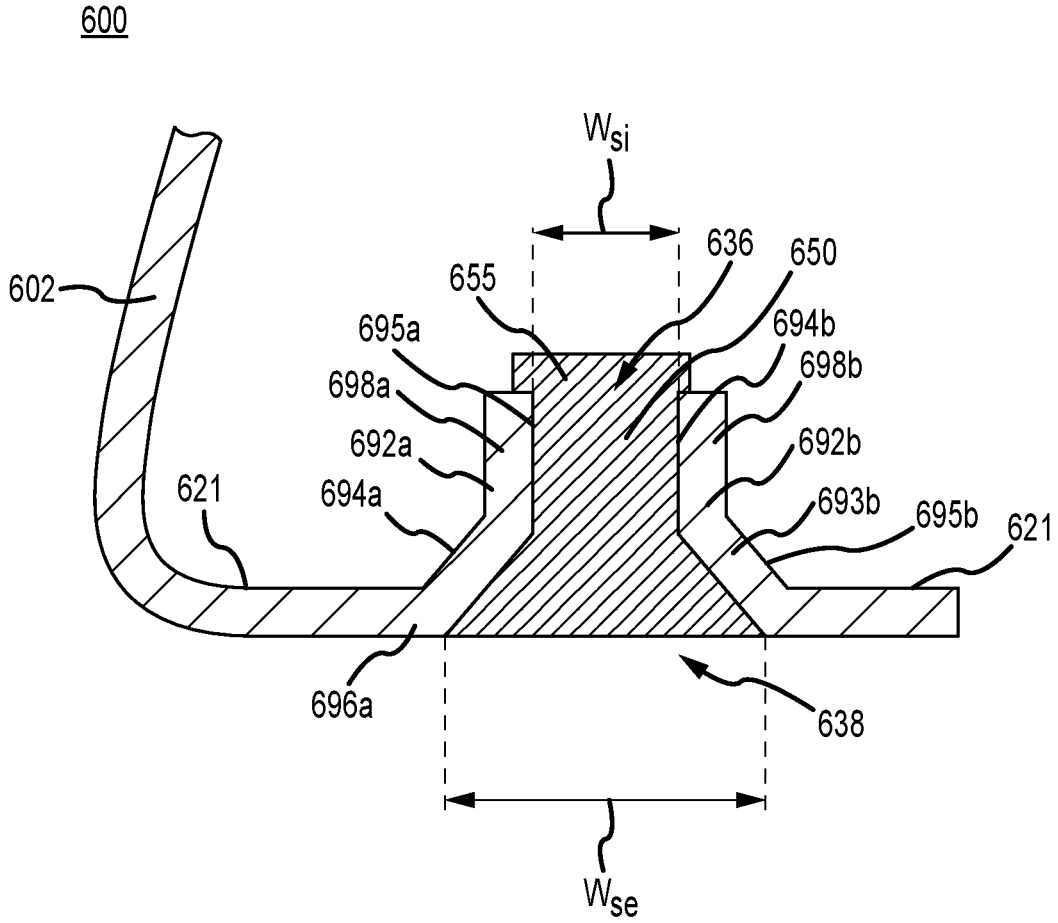
FIG. 30 illustrates a cross-sectional view of a golf club head comprising a slit formed by a plurality of retaining walls according to a second embodiment.

FIG. 30 illustrates a second embodiment of a club head 600 comprising a plurality of retaining walls 692. The retaining walls 692 (i.e. the front retaining wall 692*a* and the rear retaining wall 692*b*) can each comprise a transition portion 693 and an upper portion 698. The retaining walls 692 each comprising a transition portion 693 create a size difference between the exterior opening 638 of the slit 630 and the interior opening 636. The size difference between the exterior opening 638 and the interior opening 636 creates a mechanical stop that securely holds the flexure insert 650 within the slit 630.

Referring to FIG. 30, the front retaining wall 692*a* can comprise a front wall transition portion 693*a* beginning at the base 696*a* of the front retaining wall 692*a* and extending into the interior cavity 607. The front wall transition portion 693*a* can be angled relative to the sole interior surface 621. In many embodiments, the front surface 694*a* of the front wall transition portion 693*a* can be angled relative to the sole interior surface 621 by an angle between 30 degrees and 60 degrees. In some embodiments, the angle between the front surface 694*a* of the front wall transition portion 693*a* and the sole interior surface 621 can be between 30 and 40 degrees, 35 and 45 degrees, 40 and 50 degrees, 45 and 55 degrees, or 50 and 60 degrees. In some embodiments, the angle between the front surface 694*a* of the front wall transition portion 693*a* and the sole interior surface 621 can be approximately 30 degrees, approximately 35 degrees, approximately 40 degrees, approximately 45 degrees, approximately 50 degrees, approximately 55 degrees, or approximately 60 degrees. The angle of the front wall transition portion 693*a* provides a gradual change in geometry between the sole 612 and the front retaining wall 692*a*.

Further, the front retaining wall 692*a* comprises a front wall upper portion 698*a* extending from the end of the front transition portion 693*a* opposite the base 696*a* and further into the interior cavity 607. The front wall upper portion 698*a* can be substantially vertical such that the front wall upper portion 698*a* is approximately perpendicular to the sole interior surface 621. Said gradual change in geometry can improve durability by minimizing stress risers occurring around front retaining wall 692*a*.

Similar to the front retaining wall 692*a*, the rear retaining wall 692*b* can comprise a rear wall transition portion 693*b* beginning at the base 696*b* of the rear retaining wall 692*b* and extending into the interior cavity 607. The rear wall transition portion 693*b* can be angled relative to the sole interior surface 621. In many embodiments, the rear surface 695*b* of the rear wall transition portion 693*b* can be angled relative to the sole interior surface 621 by an angle between 30 degrees and 60 degrees. In some embodiments, the angle between the rear surface 695*b* of the rear wall transition portion 693*b* and the sole interior surface 621 can be between 30 and 40 degrees, 35 and 45 degrees, 40 and 50 degrees, 45 and 55 degrees, or 50 and 60 degrees. In some embodiments, the angle between the rear surface 695*b* of the rear wall transition portion 693*b* and the sole interior surface 621 can be approximately 30 degrees, approximately 35 degrees, approximately 40 degrees, approximately 45 degrees, approximately 50 degrees, approximately 55 degrees, or approximately 60 degrees. The angle of the rear wall transition portion 693*b* provides a gradual change in geometry between the sole 612 and the rear retaining wall 692*b*. Said gradual change in geometry can improve durability by minimizing stress risers occurring around rear retaining wall 692*b*.

Further, the rear retaining wall 692*b* comprises a rear wall upper portion 698*b* extending from the end of the rear transition portion 698*b* opposite the base 696*b* and further into the interior cavity 607. The rear wall upper portion 698*b* can be substantially vertical such that the rear wall upper portion 698*b* is approximately perpendicular to the sole interior surface 621. In many embodiments, the rear wall upper portion 698*b* can be parallel to the front wall upper portion 698*a*.

Although the embodiment of FIG. 30 illustrates the retaining walls 692 comprising flat transition portions 693, in other embodiments, the transition portion 693 can be curved or concave relative to the interior cavity 607 (as viewed in cross-section). Such curved transition portions 693 can provide an even more gradual transition between the sole 612 and the retaining walls 692.

As illustrated in FIG. 30, the front wall transition portion 693*a* and the rear wall transition portion 693*a* converge towards one another as each extends deeper into the interior cavity. The converging transition portions 693 creates a variable slit width $W_s$. The slit 630 comprises an exterior slit width $W_{se}$ located at the exterior opening 638 and an interior slit width $W_{si}$ located at the interior opening 636. In many embodiments, the exterior slit width $W_{se}$ is greater than the interior slit width $W_{si}$. The variable width $W_s$ of the slit 630 creates a mechanical stop to hold the flexure insert 650 in place. The flexure insert 650 can be shaped to complementarily fill the profile of the slit 630 formed by the retaining walls 692, sitting flush against the rear surface 695*a* of the front retaining wall 692*a* and the front surface 694 of the rear retaining wall 692*b*. Variable slit width $W_s$ allows the flexure insert 650 to be inserted through the larger exterior opening 638 but be prevented from slipping through the smaller interior opening 636 and into the interior cavity 607.

As illustrated in FIG. 30, in some embodiments, the flexure insert 650 can further comprise a stopper 655 configured to secure the flexure insert 650 within the slit 630. The stopper 655 can be located on the end of the flexure insert 650 exposed to the interior cavity 607. The stopper 655 can be a portion of the flexure insert 650 with a front-to-back width that is slightly larger than the interior slit width $W_{si}$. When the flexure insert 650 is assembled within the slit 650, the stopper 655 can overlap the top ends 697 of the retaining walls 692. The stopper provides resistance against the top ends 697 of the retaining walls 692 to prevent the flexure insert 650 from slipping out of the slit 630 through the exterior opening 638. The flexible material of the flexure insert 650 allows the stopper 655 to compress as the flexure insert 650 is press-fit into the slit 630. Once the stopper 655 passes through the interior opening 636, the stopper 655 can decompress and assume its original shape, locking the flexure insert 650 securely into place.

VI. Club Head with Slit and Strike Face Crown Return

The club heads described herein can comprise various additional features that work in conjunction with the slit (either directly or indirectly) to provide a high-performing club head. Any of the additional features described below can be provided in combination with any of the various slits 130, 230, 330, 430, 530, 630, 730, 930, 1030, 1130, 1230, 1330, 1430, 1530, 1630, 1730, 1830 and flexure inserts 150, 250, 350, 450, 550, 650, 750, 950, 1050, 1150, 1250, 1350, 1450, 1550, 1650, 1750, 1850 described herein.

Figure 31:
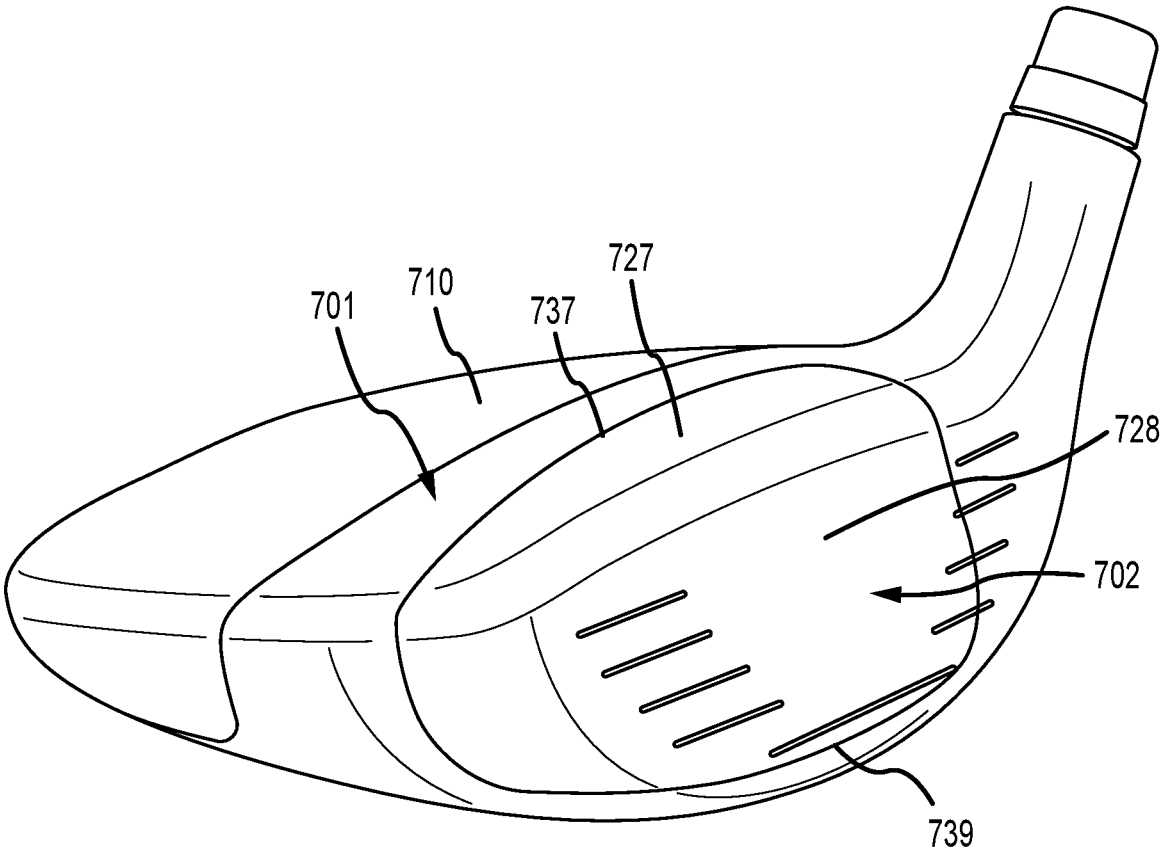
FIG. 31 illustrates a top perspective view of a golf club head comprising a slit, a flexure insert, and strike face crown return according to an embodiment.
Figure 32:
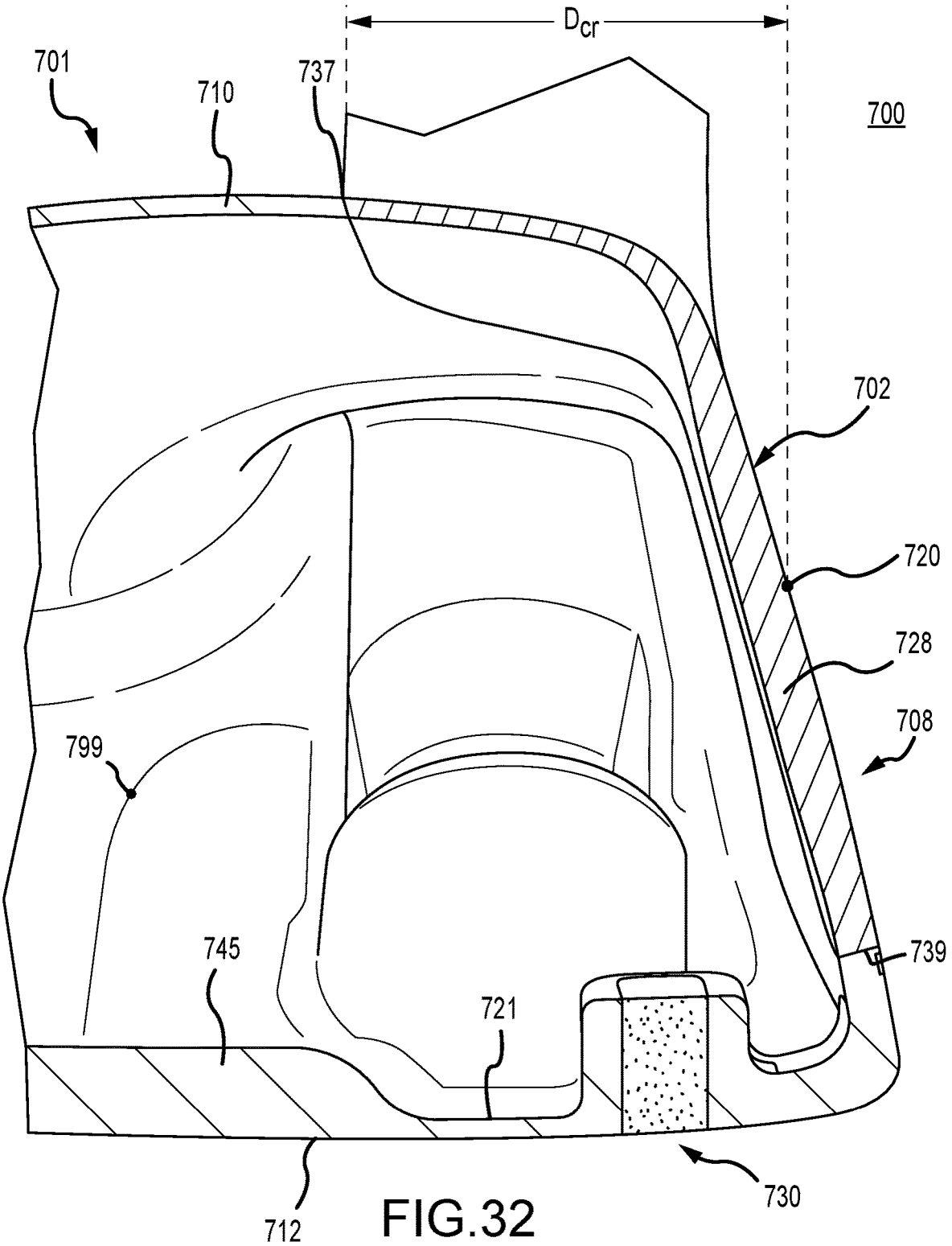
FIG. 32 illustrates a cross-sectional view of the golf club head of FIG. 31 comprising a slit, a flexure insert, and a strike face crown return.

FIGS. 31 and 32 illustrate a club head 700 comprising a slit 730 in combination with a strike face 702 comprising a crown return 727. As illustrated in FIG. 31, the strike face 702 forms a striking surface portion 728 located at the front end 708 of the club head 700 and a crown return 727 extending rearwards from the top of the striking surface portion 728. The crown return 728 can extend rearward and form at least a forward portion of the crown 710. The strike face 702 can comprise an upper perimeter 737 and a lower perimeter 739, wherein the upper perimeter 737 and the lower perimeter 739 each serve as a boundary between the strike face 702 and the body 701. For example, the upper perimeter 737 is located along a rear edge of the crown return 727 forms a boundary between the strike face 702 and the crown 710. In the embodiment of FIGS. 31 and 32, The strike face lower perimeter 739 is located on the front end 708, while the strike face upper perimeter 737 is located on the crown 715 and is spaced rearward from the front end 708.

In many embodiments, as illustrated in FIG. 32, the crown return 727 can comprise a return depth $D_{cr}$ measured in a front-to-back direction from the geometric center 720 to the upper perimeter 737. In many embodiments, the return depth $D_{cr}$ can be between 0.25 and 1.5 inches. In many embodiments, the return depth $D_{cr}$ can be between 0.25 and 0.50 inch, between 0.50 and 0.75 inch, between 0.75 and 1.0 inch, between 1.0 and 1.25 inches, or between 1.25 inch and 1.5 inches. In many embodiments, the return depth $D_{cr}$ can be greater than 0.50 inch, greater than 0.60 inch, greater than 0.70 inch, greater than 0.80 inch, greater than 0.90 inch, greater than 1.0 inch, greater than 1.1 inches, greater than 1.2 inches, greater than 1.3 inches, greater than 1.4 inches, or greater than 1.5 inches.

In many embodiments, the strike face 702 and the body 701 are formed of different materials. In many embodiments, the strike face 702 comprises a higher-strength material than the body 701. Forming a portion of the crown 710 with the crown return 727 provides higher-strength material along the transition from the front end 708 to the crown 710. The crown return 727 thereby increases the durability of said areas, which are typically at an increased risk for failure at impact.

Providing the crown return 727 places higher-strength strike face 702 material on a forward portion of the crown 710, in doing so, said forward portion of the crown 710 can be thinned without sacrificing durability. Thinning this portion of the crown 710 can increase the flexure of the strike face 702, complementing the internal energy gains created by the slit 730 to provide a maximum increase in ball speed. In many embodiments, the crown return 727 can comprise a thickness (measured from an exterior surface of the crown return 727 to an interior surface) less than 0.040 inch. In many embodiments, the crown return 727 can comprise a thickness less than 0.038 inch, less than 0.036 inch, less than 0.034 inch, less than 0.032 inch, less than 0.030 inch, less than 0.028 inch, less than 0.026 inch, less than 0.024 inch, less than 0.022 inch, or less than 0.020 inch.

Typically, the strike face 702 can be formed by stamping, pressing, or forging, rather than through a casting process. This makes it difficult for the strike face 702 to be formed into a complicated geometry. In many embodiments of the club head 700 comprising a slit 730, particularly the embodiments above describing one or more retaining walls, the geometry of the slit 730 must be cast into the sole 712. The close proximity of the slit 730 to the front end 708 in many embodiments makes it disadvantageous to form any portion of the sole 712 by the strike face 702. As such, the strike face 702 may be devoid of a sole return. In such embodiments, the strike face 702 can form a portion of the crown 710 via the crown return 727, but no portion of the sole 712.

In other embodiments (not shown), particularly embodiments with a simple slit 730 design, the strike face 702 may comprise a sole return extending rearward from the striking surface portion 728 along the sole 712. In such embodiments, the sole return may comprise one or more edges forming one or more edges of the slit 730. The strike face 702 comprising a crown return 727 can be provided in combination with any of the various slit geometries described herein and in combination with any of the various flexure insert embodiments 150, 250, 350, 450, 550, 650, 750, 950, 1050, 1150, 1250, 1350, 1450, 1550, 1650, 1750, 1850 described herein.

VII. Club Head with Slit and Mass Pad

In many embodiments, the club head comprises an internal mass pad to provide a desirable CG location that further improves golf ball performance characteristics. Referring to FIG. 32, the club head 700 comprises an internal mass pad 745 in combination with the slit 730. In many embodiments, the mass pad 745 is integrally formed from the sole interior surface 721. The mass pad 745 is a large concentration of mass with a thickness greater than the stock thickness of the sole 712. The mass pad 745 can be located between the slit 730 and the rear end 711. However, in many embodiments, the mass pad 745 can be located closer to the strike face 702 than the rear end 711 to provide the club head 700 with a relatively forward CG 799 location, reducing undesirable golf ball spin. The mass pad 745 can be provided in combination with any of the various slit geometries described herein, any of the various flexure insert embodiments 150, 250, 350, 450, 550, 650, 750, 950, 1050, 1150, 1250, 1350, 1450, 1550, 1650, 1750, 1850 described herein, or any of the other additional features described herein.

In many embodiments, as illustrated in FIG. 32, the mass pad 745 is spaced rearwardly from the slit 730. In such embodiments, the mass pad 745 does not form any portion of the slit 730 or any portion of any retaining walls 792. In such embodiments, the mass pad 745 can be separated from the slit 730 by a portion of the sole 712. In such embodiments, the mass pad 745 does not form the rear edge 734 of the slit 730 is separate and distinct from any retaining walls 792. Spacing the mass pad 745 away from the slit 730 can allow the slit to bend or flex a maximum amount. Because the mass pad 745 comprises a greater thickness (and therefore less flexibility) than the remainder of the sole 712, spacing the mass pad 745 rearward of the slit 730 can allow for greater flexure of the sole 712 and the strike face 702. Further, spacing the mass pad 745 rearward of the slit 730 can provide a more rearward CG 799 position, leading to a club head 700 with a high-MOI.

In other embodiments (not shown), it may be desirable for the mass pad 745 to be directly adjacent the slit 730 such that the mass pad 745 forms a portion of the slit 730. In such embodiments, the mass pad 745 can form at least a portion of the slit rear edge 734. Providing the mass pad 745 directly adjacent to the slit 730 can provide a more aggressive forward CG 799 position, resulting in improved golf ball launch characteristics (i.e. lower spin rate).

In many embodiments, the mass pad 745 can comprise a mass between 25 grams and 40 grams. In some embodiments, the mass pad 745 can comprise a mass between 25 and 30 grams, between 30 and 35 grams, or between 35 and 40 grams. As discussed above, in many embodiments, the mass pad 745 is integrally formed with the sole 712. In other embodiments, the mass pad 745 can be separately formed and attached to the sole 712 (either from the interior or the exterior) via adhesive and/or mechanical attachment means.

VIII. Center of Gravity and Moment of Inertia Properties

The club heads described herein provide a means for improving strike face bending dynamics to provide beneficial golf ball performance characteristics such as increased speed, higher launch, and lower spin. As described above, the slit 130 is located proximate the strike face 102 to influence the bending properties of the strike face 102. The following mass properties are applicable to any combination of the various slits 130, 230, 330, 430, 530, 630, 730, 930, 1030, 1130, 1230, 1330, 1430, 1530, 1630, 1730, 1830 and flexure inserts 150, 250, 350, 450, 550, 650, 750, 950, 1050, 1150, 1250, 1350, 1450, 1550, 1650, 1750, 1850 described herein.

Slit considerations often remove mass in the front of the club head which can negatively impact center of gravity (CG) and moment of inertia (MOI) properties. However, the club heads described herein comprise an enhanced center of gravity location thereby providing improved moment of inertia properties. Specifically, the club heads comprising the slit described herein comprise a low and rear center of gravity position, which provides a high moment inertia. Club heads comprising a high moment inertia provide increased forgiveness for off-center hits. Therefore, the various configurations of club heads comprising a slit as described herein provide improved feel, increased forgiveness, and improved playability.

To achieve the enhanced center of gravity position and high moment of inertia properties, the club head can further comprise structures that affect the mass properties of the club head such as removable weights, mass pads, thinned crown, weighted inserts, and/or lightweight crown formed from a non-metal material. These structures allow for adjustments to the mass properties to achieve a low and rear CG position and high moment of inertia properties. Described below are enhanced CG locations that provide a low and rear CG position to increase the moment of inertia and club head forgiveness.

For various embodiments of drivers-type club heads, the CGx location can range between −2 mm to 6 mm. In some embodiments, the drivers-type club head comprises a CGx location between −2 mm to 2 mm, or 2 mm to 6 mm. In some embodiments, the drivers-type club head comprises a CGx location of approximately −2 mm, −1.5 mm, −1 mm, 0 mm, 1 mm, 1.5 mm, 2 mm, 2.5 mm, 3 mm, 3.5 mm, 4, 4.5 mm, 5 mm, 5.5 mm, or 6 mm.

For various embodiments of fairway wood-type club heads, the CGx location can range between −7 mm to 1 mm. In some embodiments, the fairway wood-type club head comprises a CGx location between −7 mm to −3 mm, or −3 mm to 1 mm. In some embodiments, the fairway wood-type club head comprises a CGx location of approximately −7 mm, −6 mm, −5 mm, −4 mm, −3 mm, −2 mm, −1 mm, 0 mm, 0.5 mm, or 1 mm.

For various embodiments of hybrid-type club heads, the CGx location can range between −5 mm to 2 mm. In some embodiments, the hybrid-type club head comprises a CGx location between −5 mm to −1 mm, or −1 mm to 2 mm. In some embodiments, the hybrid-type club head comprises a CGx location between −4 mm to 0 mm, −3 mm to 1 mm, or −2 mm to 2 mm. In some embodiments, the hybrid-type club head comprises a CGx location of approximately −5 mm, −4 mm, −3 mm, −2.5 mm, −2 mm, −1.5 mm, −1 mm, −0.5 mm, 0 mm, 0.5 mm, 1 mm, 1.5 mm, or 2 mm.

For various embodiments of drivers-type club heads, the CG comprises CGy location ranging between −4 mm to −10 mm. In some embodiments, the drivers-type club head comprises a CGy location ranging between −4 to −7 mm, or −7 mm to −10 mm. In some embodiments, the drivers-type club head comprises a CGy location of approximately −4 mm, −5 mm, −6 mm, −7 mm, −8 mm, −9 mm, or −10 mm.

For various embodiments of fairway wood-type club heads, the CG comprises a CGy location ranging between −3 mm to −12 mm. In some embodiments, the fairway wood-type club head comprises a CGy location ranging between −3 mm to −7 mm, or −7 mm to −12 mm. In some embodiments, the fairway wood-type club head comprises a CGy location of approximately −3 mm, −4 mm, −5 mm, −6 mm, −7 mm, −8 mm, −9 mm, −10 mm, −11 mm, or −12 mm.

For various embodiments of hybrid-type club heads, the CG comprises CGy location ranging between −3 mm to −12 mm. In some embodiments, the hybrid-type club head comprises a CGy location ranging between −3 mm to −8 mm, or −8 mm to −12 mm. In some embodiments, the hybrid-type club head comprises a CGy location ranging between −4 mm to −8 mm, −5 mm to −9 mm, −6 mm to −10 mm, −7 mm to −11 mm, or −8 mm to −12 mm. In some embodiments, the hybrid-type club head comprises a CGy location of approximately −3 mm, −4 mm, −5 mm, −6 mm, −7 mm, −8 mm, −9 mm, −10 mm, −11 mm, or −12 mm.

For various embodiments of drivers-type club heads, the CG comprises a CGz location greater than 38 mm, greater than 40 mm, greater than 42 mm, greater than 45 mm, or greater than 48 mm. In some embodiments, the drivers-type club head comprises a CGz location ranging between 38 mm to 55 mm. In some embodiments, the drivers-type club head comprises a CGz location ranging between 38 mm to 45 mm, or 45 to 55 mm. In some embodiments, the drivers-type club head comprises a CGz location of approximately 38 mm, 39 mm, 40 mm, 41 mm, 42 mm, 43 mm, 44 mm, 45 mm, 46 mm, 47 mm, 48 mm, 49 mm, 50 mm, or 55 mm.

For various embodiments of fairway wood-type club heads, the CG can comprise a CGz location greater than 25 mm, greater than 28 mm, or greater than 30 mm. In some embodiments, the fairway wood-type club head comprises a CGz location ranging between 25 mm to 40 mm. In some embodiments, the fairway wood-type club head comprises a CGz location between 25 mm to 32 mm, or 32 mm to 40 mm. In some embodiments, the fairway wood-type club head comprises a CGz location of approximately 25 mm, 26 mm, 27 mm, 28 mm, 29 mm, 30 mm, 31 mm, 32 mm, 33 mm, 34 mm, 35 mm, 36 mm, 37 mm, 38 mm, 39 mm, or 40 mm.

For various embodiments of hybrid-type club heads, the CG can comprise a CGz location greater than 15 mm, greater than 18 mm, greater than 20 mm, greater than 22 mm, or greater than 24 mm. In some embodiments, the hybrid-type club head comprises a CGz location ranging between 15 mm to 30 mm. In some embodiments, the hybrid-type club head comprises a CGz location between 15 mm to 25 mm, or 25 mm to 30 mm. In some embodiments, the hybrid-type club head comprises a CGz location between 16 mm to 26 mm, 17 mm to 27 mm, 18 mm to 28 mm, 19 mm to 29 mm, or 20 mm to 30 mm. In some embodiments, the hybrid-type club head comprises a CGz location of approximately 15 mm, 16 mm, 17 mm, 18 mm, 19 mm, 20 mm, 21 mm, 22 mm, 23 mm, 24 mm, 25 mm, or 30 mm.

As described above and with reference to FIGS. 2-4, the center of gravity (CG) defines the origin for a coordinate system having the CG x-axis, the CG y-axis, and the CG z-axis. The CG x-axis is parallel to the x-axis, the CG y-axis is parallel to the y-axis, and the CG z-axis is parallel to the z-axis. Further, the club head comprises the moment of inertia Ixx about the CG x-axis (i.e. crown-to-sole moment of inertia), and the moment of inertia Iyy about the CG y-axis (i.e. heel-to-toe moment of inertia). In many embodiments, the crown-to-sole moment of inertia Ixx and the heel-to-toe moment of inertia Iyy are increased or maximized based on the amount of discretionary mass available to the club head designer. The moment of inertia represents the ability for the golf club head to resist twisting. A greater moment of inertia about the x-axis improves the forgiveness for high and low off-center hits. A greater moment of inertia about the y-axis improves the forgiveness for heel and toe off-center hits.

For various embodiments of drivers-type club heads, in many embodiments, the crown-to-sole moment of inertia Ixx can be greater than approximately 3000 g-cm$^2$, greater than approximately 3250 g-cm$^2$, greater than approximately 3500 g-cm$^2$, greater than approximately 3750 g-cm$^2$, greater than approximately 4000 g-cm$^2$, greater than approximately 4250 g-cm$^2$, greater than approximately 4500 g-cm$^2$, greater than approximately 4750 g-cm$^2$, or greater than approximately 5000 g-cm$^2$. For various embodiments of drivers-type club heads, in many embodiments, the crown-to-sole moment of inertia Ixx can range between 3000 g-cm$^2$ to 5000 g-cm$^2$. In other embodiments, the crown-to-sole moment of inertia Ixx can range between 3000 g-cm$^2$ to 4000 g-cm$^2$, or 4000 g-cm$^2$ to 5000 g-cm$^2$. For example, the crown-to-sole moment of inertia Ixx can be 3000 g-cm$^2$, 3100 g-cm$^2$, 3200 g-cm$^2$, 3300 g-cm$^2$, 3400 g-cm$^2$, 3500 g-cm$^2$, 3600 g-cm$^2$, 3700 g-cm$^2$, 3800 g-cm$^2$, 3900 g-cm$^2$, 4000 g-cm$^2$, 4100 g-cm$^2$, 4200 g-cm$^2$, 4300 g-cm$^2$, 4400 g-cm$^2$, 4500 g-cm$^2$, 4600 g-cm$^2$, 4700 g-cm$^2$, 4800 g-cm$^2$, 4900 g-cm$^2$, or 5000 g-cm$^2$.

For various embodiments of fairway wood-type club heads, in many embodiments, the crown-to-sole moment of inertia Ixx can be greater than approximately 1200 g-cm$^2$, greater than approximately 1300 g-cm$^2$, greater than approximately 1400 g-cm$^2$, greater than approximately 1500 g-cm$^2$, greater than approximately 1600 g-cm$^2$, greater than approximately 1700 g-cm$^2$, greater than approximately 1800 g-cm$^2$, or greater than approximately 1900 g-cm$^2$. In other embodiments, the crown-to-sole moment of inertia Ixx can range between 1200 g-cm$^2$ to 2200 g-cm$^2$. In other embodiments, the crown-to-sole moment of inertia Ixx can range between 1200 g-cm$^2$ to 1700 g-cm$^2$, or 1700 g-cm$^2$ to 2200 g-cm$^2$. For example, the crown-to-sole moment of inertia Ixx can be 1200 g-cm$^2$, 1300 g-cm$^2$, 1400 g-cm$^2$, 1500 g-cm$^2$, 1600 g-cm$^2$, 1700 g-cm$^2$, 1800 g-cm$^2$, 1900 g-cm$^2$, 2000 g-cm$^2$, 2100 g-cm$^2$, or 2200 g-cm$^2$.

For various embodiments of hybrid-type club heads, in many embodiments, the crown-to-sole moment of inertia Ixx can be greater than approximately 880 g-cm$^2$, greater than approximately 890 g-cm$^2$, greater than approximately 900 g-cm$^2$, greater than approximately 910 g-cm$^2$, greater than approximately 920 g-cm$^2$, greater than approximately 930 g-cm$^2$, greater than approximately 940 g-cm$^2$, greater than approximately 950 g-cm$^2$, or greater than approximately 960 g-cm$^2$. In other embodiments, the crown-to-sole moment of inertia Ixx can range from 880 g-cm$^2$ to 1500 g-cm$^2$. In other embodiments, the crown-to-sole moment of inertia Ixx can range from 880 g-cm$^2$ to 1200 g-cm$^2$, or 1200 g-cm$^2$ to 1500 g-cm$^2$. In other embodiments still, the crown-to-sole moment of inertia Ixx can range from 900 g-cm$^2$ to 1300 g-cm$^2$, 1000 g-cm$^2$ to 1400 g-cm$^2$, or 1100 g-cm$^2$ to 1500 g-cm$^2$. For example, the crown-to-sole moment of inertia Ixx can be 880 g-cm$^2$, 900 g-cm$^2$, 920 g-cm$^2$, 930 g-cm$^2$, 940 g-cm$^2$, 950 g-cm$^2$, 960 g-cm$^2$, 970 g-cm$^2$, 980 g-cm$^2$, 990 g-cm$^2$, 1000 g-cm$^2$, 1020 g-cm$^2$, 1100 g-cm$^2$, 1200 g-cm$^2$, 1300 g-cm$^2$, 1400 g-cm$^2$, or 1500 g-cm$^2$.

For various embodiments of drivers-type club heads, in many embodiments, the heel-to-toe moment of inertia Iyy can be greater than approximately 4500 g-cm$^2$, greater than approximately 4800 g-cm$^2$, greater than approximately 5000 g-cm$^2$, greater than approximately 5150 g-cm$^2$, greater than approximately 5250 g-cm$^2$, greater than approximately 5500 g-cm$^2$, greater than approximately 5750 g-cm$^2$, or greater than approximately 6000 g-cm$^2$. In other embodiments, the heel-to-toe moment of inertia Iyy can range between 4500 g-cm$^2$ and 6000 g-cm$^2$. In other embodiments, the heel-to-toe moment of inertia Iyy can range between 4500 g-cm$^2$ to 5200 g-cm$^2$, or 5200 g-cm$^2$ to 6000 g-cm$^2$. For example, the heel-to-toe moment of inertia Iyy can be 4500 g-cm$^2$, 4600 g-cm$^2$, 4700 g-cm$^2$, 4800 g-cm$^2$, 4900 g-cm$^2$, 5000 g-cm$^2$, 5100 g-cm$^2$, 5200 g-cm$^2$, 5300 g-cm$^2$, 5400 g-cm$^2$, 5500 g-cm$^2$, 5600 g-cm$^2$, 5700 g-cm$^2$, 5800 g-cm$^2$, 5900 g-cm$^2$, or 6000 g-cm$^2$ For various embodiments of fairway wood-type club heads, the heel-to-toe moment of inertia Iyy can be greater than approximately 2700 g-cm$^2$, greater than approximately 2800 g-cm$^2$, greater than approximately 2900 g-cm$^2$, greater than approximately 3000 g-cm$^2$, greater than approximately 3100 g-cm$^2$, greater than approximately 3200 g-cm$^2$, or greater than approximately 3300 g-cm$^2$. In other embodiments, the heel-to-toe moment of inertia Iyy can range between 2700 g-cm$^2$ and 3500 g-cm$^2$. In other embodiments, the heel-to-toe moment of inertia Iyy can range between 2700 g-cm$^2$ to 3100 g-cm$^2$, or 3100 g-cm$^2$ to 3500 g-cm$^2$. In other embodiments still, the heel-to-toe moment of inertia Iyy can range between 2700 g-cm$^2$ to 3200 g-cm$^2$, or 3200 g-cm$^2$ to 3500 g-cm$^2$. For example, the heel-to-toe moment of inertia Iyy can be 2700 g-cm$^2$, 2800 g-cm$^2$, 2900 g-cm$^2$, 3000 g-cm$^2$, 3100 g-cm$^2$, 3200 g-cm$^2$, 3300 g-cm$^2$, 3400 g-cm$^2$, or 3500 g-cm$^2$.

For various embodiments of hybrid-type club heads, in many embodiments, the heel-to-toe moment of inertia Iyy can be greater than approximately 2400 g-cm$^2$, greater than approximately 2500 g-cm$^2$, greater than approximately 2600 g-cm$^2$, greater than approximately 2700 g-cm$^2$, greater than approximately 2800 g-cm$^2$, greater than approximately 2900 g-cm$^2$, or greater than approximately 3000 g-cm$^2$. In other embodiments, the heel-to-toe moment of inertia Iyy can range from 2400 g-cm$^2$ to 3200 g-cm$^2$. In other embodiments, the heel-to-toe moment of inertia Iyy can range from 2400 g-cm$^2$ to 2700 g-cm$^2$, or 2700 g-cm$^2$ to 3200 g-cm$^2$. In other embodiments still, the heel-to-toe moment of inertia Iyy can range from 2400 g-cm$^2$ to 2900 g-cm$^2$, 2500 g-cm$^2$ to 3000 g-cm$^2$, 2600 g-cm$^2$ to 3100 g-cm$^2$, or 2700 g-cm$^2$ to 3200 g-cm$^2$. For example, the heel-to-toe moment of inertia Iyy can be 2400 g-cm$^2$, 2500 g-cm$^2$, 2600 g-cm$^2$, 2700 g-cm$^2$, 2750 g-cm$^2$, 2800 g-cm$^2$, 2850 g-cm$^2$, 2900 g-cm$^2$, 2950 g-cm$^2$, 3000 g-cm$^2$, 3100 g-cm$^2$, or 3200 g-cm$^2$.

For various embodiments of drivers-type club heads, the combined moment of inertia (i.e. the sum of the crown-to-sole moment of inertia Ixx and the heel-to-sole moment of inertia Iyy) can be greater than 8000 g-cm$^2$, greater than 8500 g-cm$^2$, greater than 9000 g-cm$^2$, greater than 9500 g-cm$^2$, greater than 10000 g-cm$^2$, greater than 11000 g-cm$^2$, or greater than 12000 g-cm$^2$.

For various embodiments of fairway wood-type club heads, the combined moment of inertia (i.e. the sum of the crown-to-sole moment of inertia Ixx and the heel-to-sole moment of inertia Iyy) can be greater than 4000 g-cm$^2$, greater than 4100 g-cm$^2$, greater than 4200 g-cm$^2$, greater than 4300 g-cm$^2$, greater than 4400 g-cm$^2$, greater than 4500 g-cm$^2$, greater than 4600 g-cm$^2$, greater than 4700 g-cm$^2$, or greater than 4800 g-cm$^2$.

For various embodiments of hybrid-type club heads, the combined moment of inertia (i.e. the sum of the crown-to-sole moment of inertia Ixx and the heel-to-sole moment of inertia Iyy) can be greater than 3500 g-cm$^2$, greater than 3600 g-cm$^2$, greater than 3700 g-cm$^2$, greater than 3800 g-cm$^2$, greater than 3900 g-cm$^2$, greater than 4000 g-cm$^2$, greater than 4100 g-cm$^2$, or greater than 4200 g-cm$^2$.

EXAMPLES

A. Example 1—Club Head with Slit and Crown Return

A comparative example was performed comparing a control club head to an exemplary embodiment according to aspects of the present invention. The exemplary embodiment was a club head similar to the club head illustrated in FIG. 18. The exemplary embodiment comprises a slit and a strike face crown return. The strike face crown return is formed from the same high-strength material as the strike face. The strike face crown return extends from the top of the striking surface portion into the forward portion of the crown. The crown return of the strike of the exemplary embodiment comprises a thickness of approximately 0.025 inch. The control club head comprises a slit and a face insert such that the crown return is formed from a different material than the strike face. The crown return of the control club head was approximately 0.035 inch. The slit of the control club head and the exemplary embodiment comprises the same geometries and features.

The data was collected using Finite Element Analysis (FEA). The FEA simulation featured a golf ball striking the center of the face at approximately 100 MPH. The FEA simulation determined that the exemplary embodiment comprises a 0.67 MPH increase in ball speed over the control club head. Therefore, the strike face crown return, in which the crown return comprises the same material as the strike face, had an improvement in ball speed over the control club head which lacked the strike face crown return. The strike face crown return allows the crown to made thinner, and as such, bend more upon impact with a golf ball resulting in an increase in ball speed.

B. Example 2—Flexure Insert vs Control Insert

A comparative example is being performed using Finite Element Analysis (FEA). The FEA test will compare the performance of an exemplary club head with a flexure insert according to an embodiment of the present invention to a control cub head with an insert. The exemplary flexure insert being used in the test is similar to the insert of FIGS. 6-9. The flexure insert comprises a slit with a U-Shape spring component and a cap. The control club head comprises a slit with a single viscoelastic material. The slit geometries as well as other club head features of the control club head and the exemplary club head are approximately the same.

The FEA test is expected to show the exemplary club head comprising approximately 0.5 MPH to 5 MPH increase in ball speed over the control club head.

CLAUSES

Clause 1: A golf club head comprising a strike face comprising a striking surface for impacting a golf ball; a body comprising a crown, a sole, a heel, a toe, and a rear end; wherein the strike face and body are configured to be secured together to enclose a hollow interior cavity; the sole defines a slit proximate the strike face, wherein the slit provides an opening communicating between the hollow interior cavity and the exterior of the club head; the slit comprising a forward edge located adjacent the strike face and a rearward edge opposite the forward edge; wherein the forward edge and the rearward edge define boundaries of the slit; the slit is configured to receive a flexure insert; the flexure insert comprises a spring component and a cap; the spring component comprises a first material having a first modulus of elasticity; the cap comprises a second material having a second modulus of elasticity; wherein the first modulus of elasticity is greater than the second modulus of elasticity; the flexure insert is coupled to the forward edge and the rearward edge of the slit; wherein the flexure insert fills the opening and seals the interior cavity; and wherein the flexure insert is configured to flex with the sole during a golf ball impact.

Clause 2: The golf club head of clause 1, wherein the spring component is at least partially embedded within the cap.

Clause 3: The golf club head of clause 1, wherein the first material is selected from the group consisting of plastic, composite thermoset, steel, stainless steel, spring steel, titanium, and aluminum.

Clause 4: The golf club head of clause 1, wherein the first modulus of elasticity is between 20 GPa and 210 GPa.

Clause 5: The golf club head of clause 1, wherein the second material is an injection molded polymer.

Clause 6: The golf club head of clause 1, wherein the second modulus of elasticity is between 0.1 GPa and 30 GPa.

Clause 7: The golf club head of clause 1, wherein the slit further comprises a front recessed portion formed into a front surface of the slit and a rear recessed portion into a rear surface of the slit.

Clause 8: The golf club head of clause 7, wherein: the spring component comprises a front wall and a rear wall; the front wall comprises a front protrusion extending forwardly from the front wall; the rear wall comprises a rear protrusion extending rearwardly from the rear wall; wherein the front protrusion is configured to be received within the front recessed portion; and wherein the rear protrusion is configured to be received within the rear recessed portion.

Clause 9: The golf club head of clause 1, wherein: the slit comprises a slit length measured as a heel-to-toe distance between a heel most point of the slit to a toe most point of the slit; the spring component comprises a spring component length that is a heel-to-toe distance from a heel most point of the spring component to a toe most point of the spring component; wherein the spring component length is between 10% and 50% of the slit length.

Clause 10: The golf club head of clause 9, wherein: the slit further comprises a slit heel portion located on a heel side of the club head, a slit toe portion located on a toe side of the club head, and a slit central portion located between the slit heel portion and the slit toe portion; wherein the spring component is located within the slit central portion; and wherein the slit heel portion and the slit toe portion are devoid of the spring component.

Clause 11: The golf club head of clause 1, further comprising: an internal mass pad integrally formed with an interior surface of the sole; wherein the internal mass pad is rearward of the slit and is separated from the slit by a portion of the sole.

Clause 12: The golf club head of clause 11, wherein the internal mass pad comprises a mass between 25 grams and 40 grams.

Clause 13: A golf club head comprising: a strike face comprising a striking surface for impacting a golf ball and a geometric center; a body comprising a crown, a sole, a heel, a toe, and a rear end; wherein the strike face and body are configured to be secured together to enclose a hollow interior cavity; the strike face further comprises a crown return extending rearward from a top of the striking surface, the crown return forming at least a forward portion of the crown; the sole defines a slit proximate the strike face, wherein the slit provides an opening communicating between the hollow interior cavity and the exterior of the club head; the slit comprising a forward edge located adjacent the strike face and a rearward edge opposite the forward edge; wherein the forward edge and the rearward edge define boundaries of the slit; the slit is configured to receive a flexure insert; the flexure insert comprises a spring component and a cap; the spring component comprises a first material having a first modulus of elasticity; the cap comprises a second material having a second modulus of elasticity; wherein the first modulus of elasticity is greater than the second modulus of elasticity; the flexure insert is coupled to the forward edge and the rearward edge of the slit; wherein the flexure insert fills the opening and seals the interior cavity; wherein the flexure insert is configured to flex with the sole during a golf ball impact; and wherein the club head experiences an increase in ball speed between 0.5 mph and 4.5 mph at a club head speed of 100 mph in comparison to a similar club head comprising an insert devoid of a spring component.

Clause 14: The golf club head of clause 13, wherein the crown return comprises a crown return thickness less than 0.030 inch.

Clause 15: The golf club head of clause 13, wherein the strike face further comprises an upper perimeter located along a rear edge of the crown return, wherein the upper perimeter forms a boundary between the strike face and the crown.

Clause 16: The golf club head of clause 15, wherein: the crown return comprises a crown return depth measured in a front-to-back direction from the geometric center to the upper perimeter; and wherein the crown return depth is greater than 0.50 inch.

Clause 17: A golf club head comprising: a strike face comprising a striking surface for impacting a golf ball; a body comprising a crown, a sole, a heel, a toe, and a rear end; wherein the strike face and body are configured to be secured together to enclose a hollow interior cavity; the sole defines a slit proximate the strike face, wherein the slit provides an opening communicating between the hollow interior cavity and the exterior of the club head; the slit comprising a forward edge located adjacent the strike face and a rearward edge opposite the forward edge; wherein the forward edge and the rearward edge define boundaries of the slit; the slit is configured to receive a flexure insert; the flexure insert comprises a spring component and a cap; the spring component comprises a first material and the cap comprises a second material; the spring component comprises a front wall, a rear wall, and a U-shaped top wall; wherein the U-shaped top wall extends in a curved manner into the interior cavity and connects the front wall and the rear wall; wherein the slit further comprises a front recessed portion formed into a front surface of the slit and a rear recessed portion into a rear surface of the slit; the front wall comprises a front protrusion extending forwardly from the front wall: the rear wall comprises a rear protrusion extending rearwardly from the rear wall: wherein the front protrusion is configured to be received within the front recessed portion; and wherein the rear protrusion is configured to be received within the rear recessed portion.

Clause 18: The golf club head of clause 17, wherein the spring component is at least partially embedded within the cap.

Clause 19: The golf club head of clause 18, wherein the first material is selected from the group consisting of plastic, composite thermoset, steel, stainless steel, spring steel, titanium, and aluminum.

Clause 20: The golf club head of clause 19, wherein the second material is an injection molded polymer.

The invention claimed is:

1. A golf club head comprising:

a strike face comprising a striking surface for impacting a golf ball;

a body comprising a crown, a sole, a heel, a toe, and a rear end;

wherein the strike face and body are configured to be secured together to enclose a hollow interior cavity;

the sole defines a slit proximate the strike face, wherein the slit provides an opening communicating between the hollow interior cavity and an exterior of the club head;

the slit comprising a forward edge located adjacent the strike face and a rearward edge opposite the forward edge;

wherein the forward edge and the rearward edge define boundaries of the slit;

the slit is configured to receive a flexure insert;

the flexure insert comprises a spring component and a cap;

the spring component comprises a first material and the cap comprises a second material;

the spring component comprises a front wall, a rear wall, and a U-shaped top wall;

wherein the U-shaped top wall extends in a curved manner into the interior cavity and connects the front wall and the rear wall;

wherein the slit further comprises a front recessed portion formed into a front surface of the slit and a rear recessed portion into a rear surface of the slit;

the front wall comprises a front protrusion extending forwardly from the front wall:

the rear wall comprises a rear protrusion extending rearwardly from the rear wall:

wherein the front protrusion is configured to be received within the front recessed portion; and wherein the rear protrusion is configured to be received within the rear recessed portion.

2. The golf club head of claim 1, wherein the spring component is at least partially embedded within the cap.

3. The golf club head of claim 2, wherein the first material is selected from the group consisting of: plastic, composite thermoset, steel, stainless steel, spring steel, titanium, and aluminum.

4. The golf club head of claim 3, wherein the second material is an injection molded polymer.

* * * * *